US006481822B2

(12) United States Patent
Murcia et al.

(10) Patent No.: US 6,481,822 B2
(45) **Date of Patent: *Nov. 19, 2002**

(54) INDEPENDENT SERVICING OF MULTIPLE INKJET PRINTHEADS

(75) Inventors: Antoni Murcia; Xavier Bruch; Emilio Angulo, all of Barcelona (ES); Eric Joseph Johnson, Sacramento, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 11 days.

This patent is subject to a terminal disclaimer.

(21) Appl. No.: 09/793,316

(22) Filed: Feb. 26, 2001

(65) Prior Publication Data

US 2001/0012027 A1 Aug. 9, 2001

Related U.S. Application Data

(63) Continuation of application No. 09/253,381, filed on Feb. 19, 1999, now Pat. No. 6,203,135, which is a continuation-in-part of application No. 09/227,448, filed on Jan. 8, 1999, now Pat. No. 6,135,585.

(51) Int. Cl.[7] ..... B41J 2/165

(52) U.S. Cl. ..... 347/22; 347/29; 347/32; 347/33

(58) Field of Search ..... 347/22, 29, 30, 347/31, 32, 33, 35, 36

(56) References Cited

U.S. PATENT DOCUMENTS

| | | | | |
|---|---|---|---|---|
| 5,914,734 A | | 6/1999 | Rotering et al. | 347/28 |
| 5,984,450 A | | 11/1999 | Becker et al. | 347/24 |
| 6,203,135 B1 | * | 3/2001 | Murcia et al. | 347/22 |

FOREIGN PATENT DOCUMENTS

| | | |
|---|---|---|
| EP | 0 576 172 A2 | 10/1993 |
| EP | 0 822 086 A2 | 7/1997 |

* cited by examiner

*Primary Examiner*—John Barlow
*Assistant Examiner*—Shih-wen Hsieh

(57) ABSTRACT

Service station components for interacting with one type of printhead are located to be aligned in operative position only in a first servicing mode, and service station components for interacting with another type of printhead are differently located to be aligned in operative position only in a second servicing mode. This allows for different servicing schemes of two or more modes to be applied based on the individual characteristics of the ink and/or nozzle plates employed in inkjet printheads. In some instances, an individual printhead can be serviced in more than one servicing mode. In a preferred embodiment, replaceable service station units are provided for each different printhead.

22 Claims, 16 Drawing Sheets

| C | Y | K | M | $C_2$ | $M_2$ |
|---|---|---|---|---|---|
| WIPE | WIPE | – | WIPE | – | – |

| C | Y | K | M | $C_2$ | $M_2$ |
|---|---|---|---|---|---|
| – | – | WIPE | – | – | – |

| C | Y | K | M | $C_2$ | $M_2$ |
|---|---|---|---|---|---|
| – | – | – | – | WIPE | WIPE |

| K | $C_1$ | Y | $M_1$ | $C_2$ | $M_2$ |
|---|---|---|---|---|---|
| WIPE | WIPE | – | WIPE | WIPE | – |

| K | $C_1$ | Y | $M_1$ | $C_2$ | $M_2$ |
|---|---|---|---|---|---|
| WIPE | – | WIPE | – | – | – |

| K | $C_1$ | Y | $M_1$ | $C_2$ | $M_2$ |
|---|---|---|---|---|---|
| WIPE | – | – | – | WIPE | WIPE |

INDEPENDENT SERVICING OF MULTIPLE INKJET PRINTHEADS

CROSS REFERENCE TO RELATED APPLICATION(S)

This is a continuation of application Ser. No. 09/253,381 filed on Feb. 19, 1999 U.S. Pat. No. 6,203,135.

This is a continuation-in-part of U.S. Ser. No. 09/227,448 filed on Jan. 8, 1999 entitled "Replaceable Capping System For Inkjet Printheads", now U.S. Pat. No. 6,135,585, assigned to the present assignee and incorporated herein by reference.

BACKGROUND OF THE INVENTION

Inkjet printing mechanisms may be used in a variety of different products, such as plotters, facsimile machines and inkjet printers, to print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with a full supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multi-color cartridges, several printheads and reservoirs are combined into a single unit, with each reservoir/printhead combination for a given color also being referred to herein as a "pen."

Each pen has a printhead formed with very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in one or more linear arrays. If more than one, the two linear arrays are located side-by-side on the printhead, parallel to one another, and perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The height of this band is known as the "swath height" of the pen, the maximum pattern of ink which can be laid down in a single pass.

It is apparent that the speed of printing a sheet can be increased if the swath height is increased. That is, a printhead with a wider swath would require fewer passes across the sheet to print the entire image, and fewer passes would increase the throughput of the printing mechanism. "Throughput," also known as the pages-per-minute rating, is often one of major considerations that a purchaser analyzes in deciding which printing mechanism to buy. While merely lengthening the nozzle array to increase throughput may seem to the inexperienced-an easy thing to accomplish, this has not been the case. For thermal inkjet pens in particular, there are some physical and/or manufacturing constraints to the size of the substrate layer within the printhead. In the past, inkjet printheads have been limited in swath height to around 5.4 mm (millimeters) for tri-chamber color printheads, and around 12.5 mm (about one-half inch) for monochrome printheads, such as black printheads.

To clean and protect the printhead, typically a "service station" mechanism is mounted within the plotter chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit or other mechanism that draws a vacuum on the printhead. During operation, clogs in the printhead are periodically cleared by firing a number of drops of ink through each of the nozzles in a process known as "spitting," with the waste ink being collected in a "spittoon" reservoir portion of the service station.

After spitting, uncapping, or occasionally during printing, most service stations have an elastomeric wiper that wipes the printhead surface to remove ink residue, as well as any paper dust or other debris that has collected on the face of the printhead. Other service stations include auxiliary wiping members to clean areas of the pen adjacent to the ink ejecting nozzles. For instance, a pair of "mud flaps" in the models 720C and 720C DeskJet® color inkjet printers wipe regions beside the color nozzles, while a "snout wiper" in the models 2000 and 2500 DesignJet® color inkjet plotters wipe a rear vertical surface underneath an electrical interconnect region of the pen, with these printers and plotters both being sold by the present assignee, the Hewlett-Packard Company of Palo Alto, Calif.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies. fabric and other media.

Indeed, keeping the nozzle face plate clean for cartridges using pigment based inks has proven quite challenging. In the past, multiple inkjet printheads were wiped simultaneously, all at the same speed, which was fine when all the cartridges contained the same type (albeit different colors) of ink. However, these pigment based inks are less viscous than the dye based inks, so the pigment based inks require a slower wiping speed than that previously needed for dye based inks. Yet, there is a lower limit to the wiping speed because too slow a wipe wicks excessive amounts of ink from the dye based pens. This excess dye based ink eventually builds-up a residue on the wiper, leading to less effective wiping in the future, as well as other problems. For instance, excess residue around the wipers may lead to ink build-up around the service station, which could contaminate the caps. Printhead cap contamination may lead to shorter cartridge life because ineffective capping may induce failures in the printhead.

Actually, a scrubbing type of wiping routine is preferred to clean the tar-like pigment ink residue from the printheads. If a faster wipe was used to accommodate the dye based inks, the wiper for the pigment based ink is prevented from making full contact with the residue. Instead, the wiper skips over bumps formed from the tar-like pigment based ink residue in a jerking or stuttering type of motion, which fails to remove the residue from the printhead. In some cases, during this faster wiping stroke the wiper for the pigment based ink flexed and wiped over the tar-like residue, which smeared the ink over the orifice plate rather than removing it. Thus, any compromise in attempting to accommodate the wiping needs of one pen was at the sacrifice of meeting the needs of the other type of pen.

As the inkjet industry investigates new printhead designs, the tendency is toward using permanent or semi-permanent printheads in what is known in the industry as an "off-axis" printer. Recent breakthroughs in technology have given hope to developing a printhead with a 25 mm swath height (about one inch high), which is double the height previously obtainable, and future developments may bring about even wider swath printheads. While there are a variety of advantages associated with these off-axis printing systems, the possibility of a wider swath height brings on other problems which have not previously been encountered, such as how to provide a uniformly adequate seal when capping the longer printhead, and how to seal the longer printhead without de-priming the nozzles. Moreover, the permanent or semi-permanent nature of the off-axis printheads requires special considerations for servicing, such as how to store ink spit over the printhead lifetime, and how to wipe ink residue from the printheads without any appreciable wear that could decrease printhead life.

To accomplish this wiping objective, an ink solvent, such as a polyethylene glycol ("PEG") compound has been used in the HP HP 2000C color inkjet printer, sold by the Hewlett-Packard Company. In this system the ink solvent is stored in a porous medium such as a plastic or foam block in intimate contact with a reservoir, with this porous block having an applicator portion exposed in such a way that the elastomeric wiper can contact the applicator. The wiper moves across the applicator to collect PEG, which is then wiped, across the printhead to dissolve accumulated ink residue and to deposit a non-stick coating of PEG on the printhead face to retard farther collection of ink residue. The wiper then moves across a rigid plastic scraper to remove dissolved ink residue and dirtied PEG from the wiper before beginning the next wiping stroke. The PEG fluid also acts as a lubricant, so the rubbing action of the wiper does not unnecessarily wear the printhead. Unfortunately, this solvent system uses many parts to accomplish this wiping routine, with multiple parts requiring multiple tooling costs, ordering, inventory tracking and assembly. Moreover, over the lifetime of the printer, the PEG ink solvent may need to be replenished to maintain optimum printhead servicing.

SUMMARY OF THE INVENTION

An overall goal of the present invention is to provide an inkjet printing, mechanism which reliably produces clear crisp images over the life of the printing mechanism.

Another goal of the present invention is to provide a servicing system for inkjet printheads through linear movement of replaceable printhead servicing units.

Another goal of the present invention is to provide a replaceable inkjet printhead cleaner service station system and servicing, method which maintains printhead life, particularly when using permanent or semipermanent printheads and/or printheads having a swath width on the order of at least 20 mm to 25 mm (about one inch).

Service station components for interacting with one type of printhead are located to be aligned in operative position only in a first servicing mode, and service station components for interacting with another type of printhead are differently located to be aligned in operative position only in a second servicing mode. This allows for different servicing schemes of two or more modes to be applied based on the individual characteristics of the ink and/or nozzle plates employed in inkjet printheads. In some instances, an individual printhead can be serviced in more than one servicing mode. In a preferred embodiment, replaceable service station units are provided for each different printhead.

BRIEF DESCRIPTION OF THE DRAWINGS

FIGS. 14A and 143B are schematic tabular representations of two different servicing modes which both include black ink servicing.

FIGS. 17A, 117B and 17C are schematic tabular representations of three different servicing modes for six printheads, with two printheads included in more than one mode.

DETAILED DESCRIPTION OF THE PREFERRED EMBODIMENTS

Figure 1:
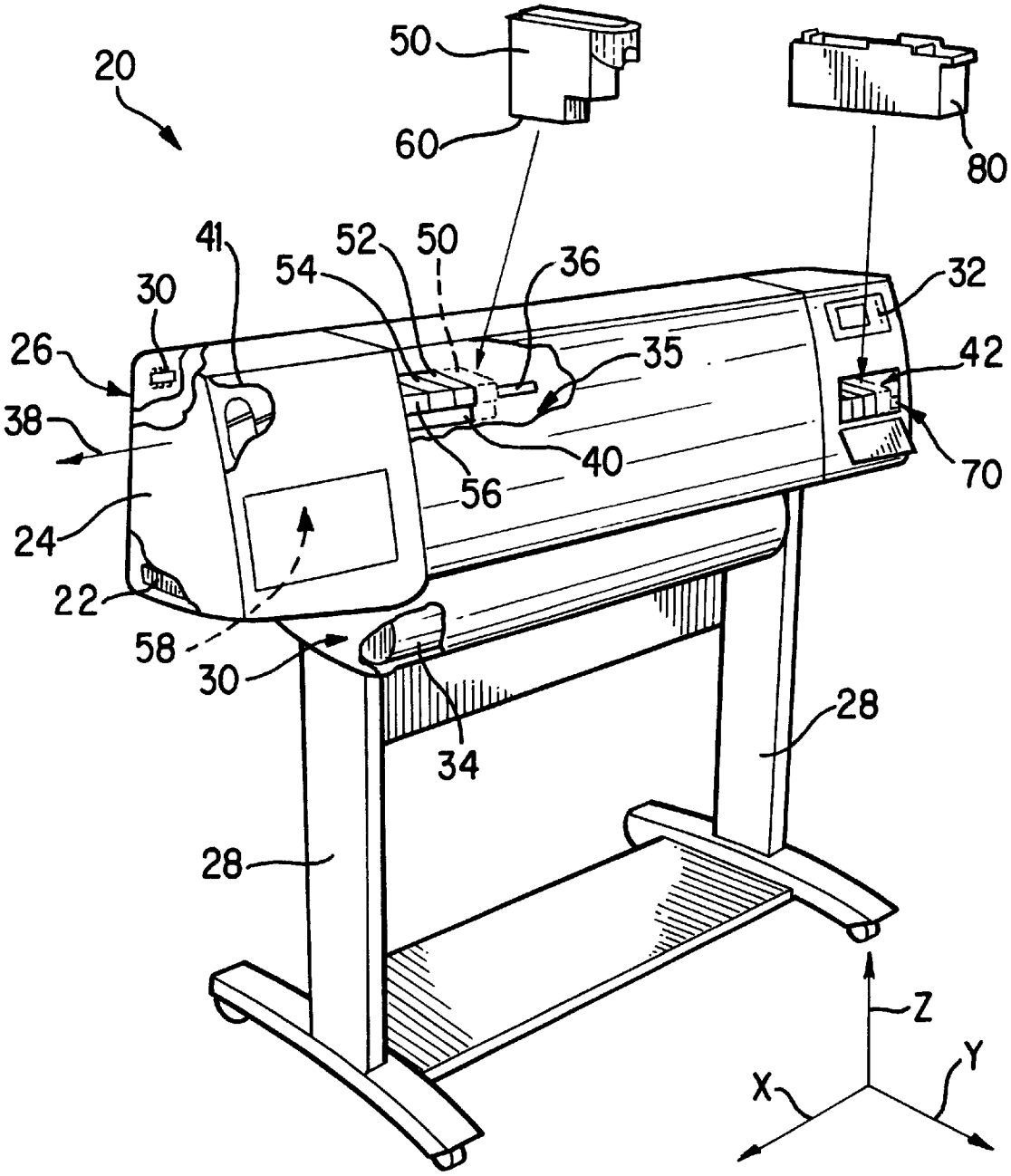
FIG. 1 is a perspective view of one form of an inkjet printing mechanism, here an inkjet plotter, including one form of a replaceable inkjet printhead cleaner service station system of the present invention, shown here to service a set of inkjet printheads each having a large print swath, for instance about 20–25 mm (one inch) wide.

FIG. 1 illustrates an embodiment of an inkjet printing mechanism, here shown as an inkjet plotter 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, cameras, video printers, and facsimile machines, to name a few. For convenience the concepts of the present invention are illustrated in the environment of an inkjet plotter 20.

While it is apparent that the plotter components may vary from model to model, the typical inkjet plotter 20 includes a chassis 22 surrounded by a housing or casing enclosure 24, typically of a plastic material, together forming a print assembly portion 26 of the plotter 20. While it is apparent that the print assembly portion 26 may be supported by a desk or tabletop, it is preferred to support the print assembly portion 26 with a pair of leg assemblies 28. The plotter 20 also has a plotter controller, illustrated schematically as a microprocessor 30, that receives instructions from a host device, typically a computer, such as a personal computer or a computer aided drafting (CAD) computer system (not shown). The plotter controller 30 may also operate in response to user inputs provided through a key pad and status display portion 32, located on the exterior of the casing 24. A monitor coupled to the computer host may also be used to display visual information to an operator, such as the plotter status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor 41 may be used to propel the carriage 40 in response to a control signal received from the controller 30. To provide carriage positional feedback information to controller 33, a conventional metallic encoder strip (not shown) may be extended along the length or the printzone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Moreover, the illustrated inkjet printing mechanism may also be used for printing images on pre-cut sheets, rather than on media supplied in a roll 34.

Figure 2:
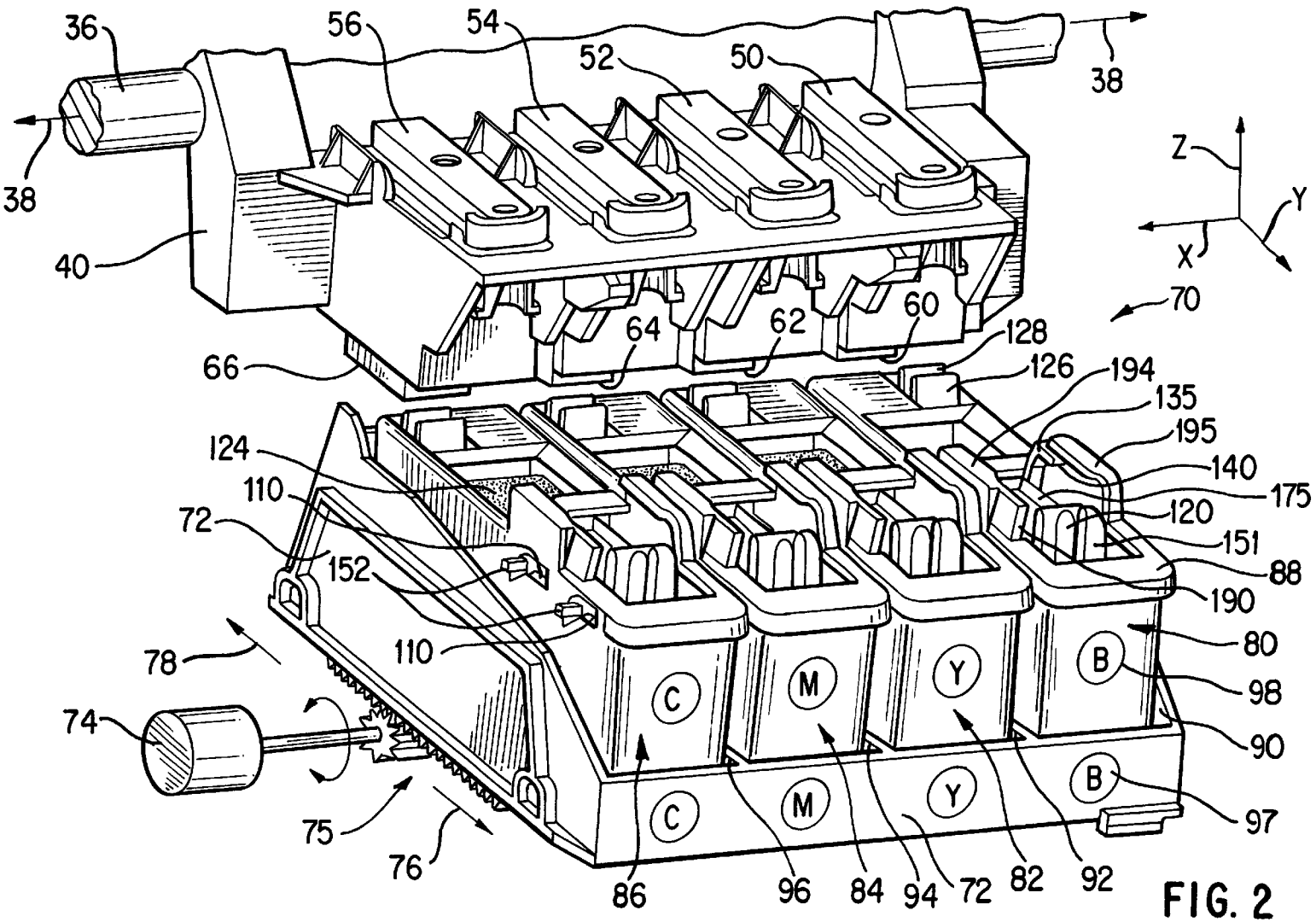
FIG. 2 is an enlarged perspective view of the replaceable service station system shown prior to servicing the wide swath printheads of FIG. 1.

In the printzone 35, the media sheet receives ink from an inkjet cartridge, such as a black ink cartridge 50 and three monochrome color ink cartridges 52, 54 and 56, shown in greater detail in FIG. 2. The cartridges 50–56 are also often called "pens" by those in the art. The black ink pen 50 is illustrated herein as containing a pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics. The illustrated plotter 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "pen" or "cartridge" may also refer to replaceable printhead cartridges where each pen has a reservoir that carries the entire ink supply as the printhead reciprocates over the printzone.

The illustrated pens 50, 52, 54 and 56 have printheads 60, 62, 64 and 66, respectively, which selectively eject ink to from an image on a sheet of media 34 in the printzone 35. These inkjet printheads 60–66 have a large print swath, for instance about 20 to 25 millimeters (about one inch) wide or wider, although the printhead maintenance concepts described herein may also be applied to smaller inkjet printheads. The concepts disclosed herein for cleaning the printheads 60–66 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 60, 62, 64 and 66 each have an orifice plate with a plurality of nozzles formed therethrough in a manner well known to those skilled in the art. The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of as is formed which ejects a droplet of ink from the nozzle and onto a sheet of paper in the printzone 35 under the nozzle. The printhead resistors are selectively energized in response to firing command control signals delivered from the controller 30 to the printhead carriage 40.

FIG. 2 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54 and 56. Each of the cleaner units 80–86 include an installation and removal handle 88, which may be gripped by an operator when installing the cleaner units 80–38 in their respective chambers or stalls 90, 92, 94, and the 96 defined by the service station pallet 72. Following removal, the cleaning units 80–86 are typically disposed of and replaced with a fresh unit, so the units 80–86 may also be referred to as "disposeable cleaning units," although it may be preferable to return the spent units to a recycling center for refurbishing. To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

Figure 3:
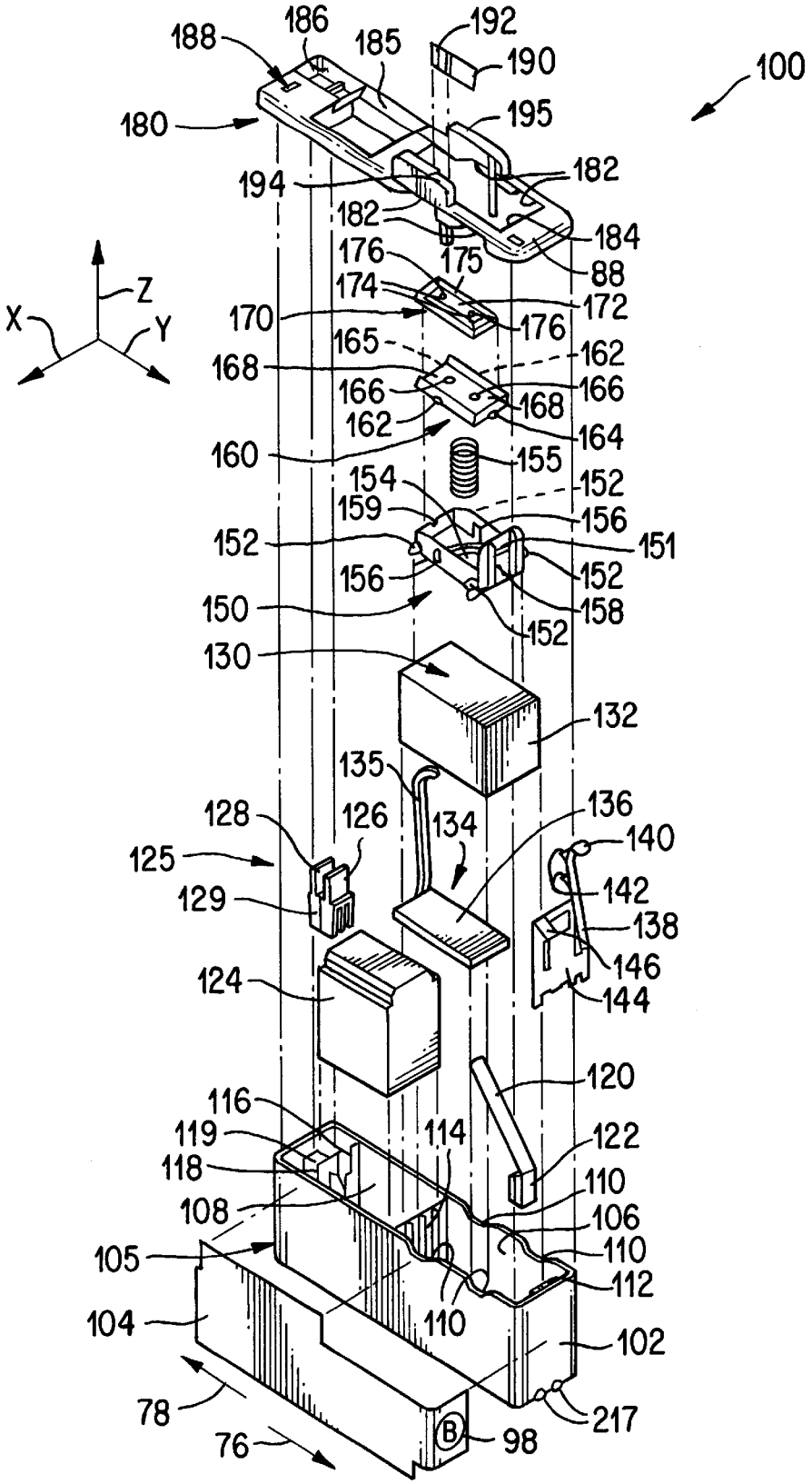
FIG. 3 is an enlarged exploded perspective view of a replaceable inkjet printhead cleaner unit of the service station system of FIG. 1.

FIG. 3 illustrates a generic cleaner unit assembly 100, including components for assembling both the black printhead cleaner unit 80 and the color cleaner units 82–86. Beginning near the bottom of the figure, and working upward, the generic cleaner unit 100 includes a base 102, to which a label 104 carrying indicia, such as the "B" marking 98 for the black cleaner unit 80, which may affixed to the exterior of base 102. Furthermore, to assure that the cleaner units 80–86 cannot be physically inserted in the wrong pallet stall 90–96, a series of mounting tabs unique for each of the cleaner units 80–86 may be molded alone a rear corner 105 of the base 102, with mating slots being supplied within the rear portion of the stalls 90–96 of the pallet 72. The base 102 defines two reservoir chambers, including an ink solvent chamber 106 and a spittoon chamber 108. Other features of the base 102 include four cam surfaces or cap ramps 110, which are used during the printhead capping and uncapping process as described further below. The base 102 also defines several different mounting locations for other components of the cleaner unit 100, including a cap return spring mounting wall 112, a solvent applicator spring mounting wall 114, a black wiper mounting wall 116, a color wiper mounting wall 118, with a brace wall 119 extending between the black and color wiper mounting walls 116 and 118.

The generic cleaning unit assembly unit 100 also includes a cap sled return spring 120, which includes a mounting lip 122 received by the cap spring mounting wall 112 of base 102. For the color cleaner units 82–86 the spittoon 108 is filled with an ink absorber 124, preferably of a foam material, although a variety of other absorbing materials may also be used. The absorber 124 receives ink spit from the color printheads 62–66, and the hold this ink while the volatiles or liquid components evaporate, leaving the solid components of the ink trapped within the chambers of the foam material. The spittoon 108 of the black cleaner unit 80 is supplied as an empty chamber, which then fills with the tar-like black ink residue over the life of the cleaner unit.

A dual bladed wiper assembly 125 has two wiper blades 126 and 128, which are preferably constructed with rounded exterior wiping edges, and an angular interior wiping edge, as described in the Hewlett-Packard Company's U.S. Pat. No. 5,614,930. The wiper assembly 125 includes a base portion 129 which resiliently grips the black wiper mounting wall 116 when assembling the black cleaner unit 30. When assembling the color cleaner units 82–86, the wiper base 129 is installed on the color wiper mounting wall 118. Preferably, each of the wiper assemblies 125 is constructed of a flexible, resilient, non-abrasive, elastomeric material, such as nitrile rubber, or more preferably, ethylene polypropylene diene monomer (EPDM), or other comparable materials known in the art. For wipers 125, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, the ink solvent chamber 106 receives an ink solvent 130, which is held within a porous solvent reservoir body or block 132 installed within chamber 106. Preferably, the reservoir block 132 is made of a porous material, for instance, an open-cell thermoset plastic such as a polyurethane foam, a sintered polyethylene, or other functionally similar materials known to those skilled in the art. The inkjet ink solvent 130 is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block 132 is soaked with the preferred ink solvent, PEG.

To deliver the solvent 130 from the reservoir 132, the black cleaner unit 80 includes a solvent applicator or distribution member 134, which includes an applicator wick 135 and a base 136, which underlies the reservoir block 132. To hold the applicator wick 135 in place, the black cleaner unit 80 includes a wick spring 138 which terminates at a lip 140 that receives the distal end of the applicator wick 135. To further support the wick 135, the wick spring also includes two pairs of support tabs 142. The wick spring 138 has a mounting tab 144 which is supported by the spring mounting 114 of base 102. Another feature of the wick spring 138, is a reservoir securing tab 146, which rests over an upper service surface of the solvent reservoir block 132 to hold it in place within the solvent chamber 106 of base 102.

The generic cleaning unit assembly 100 also includes a cap sled 150 which has an activation wall 151 with a rear surface pushed by the printhead into a capping position and a front surface used to move the sled back into a rest position. The cap sled 150 has four cam followers 152 which ride along the cap ramps or cams 110 of base 102. The interior of the cap sled 150 defines a spring receiving chamber 154, which receives a compression spring 155. The cap sled 150 defines a pair of laterally opposing slots 156, and a pair of longitudinally opposing slots 158 and 159, with slots 156 and 158 being enclosed slots, and the slot 159 having an open upper end to aid in assembly of the cleaner unit.

The generic cleaning unit 100 also includes a cap retainer member 160 which includes a pair of laterally opposing pins or posts 162 which are captured within the pair of slots 156 of the cap sled 150. The cap retainer 160 also includes two longitudinally opposing pins or posts 164 and 165, which are received within the respective slots 158 and 159 of the cap sled 150. Use of the posts 162, 164 and 165 in conjunction with the slots 156, 158 and 159 and the spring 155, allow the cap retainer to be gimbal-mounted to the cap sled 110, allowing the retainer 160 to move in the Z axis direction, while also being able to tilt between the X and Y axes, which aids in sealing the printheads 60–66. The cap retainer 160 also includes a pair of cap lip mounting posts or flanges 166. The retainer 160 also has an upper surface 168, which may define a series of channels or troughs, to act as a vent path to prevent depriming the printheads 60–66 upon sealing, for instance as described in the allowed U.S. patent application Ser. No. 08/566,221 currently assigned to the present assignee, the Hewlett-Packard Company.

Overlying the cap retainer 160 is a cap lip member 170, which may be constructed of the same material used for the wiper assemblies 125. The cap lip member 170 has a base portion 172 which defines a pair of mounting holes 174 therethrough which are slip-fit or press-fit over the retainer flanges 166. Each retainer flange 166 has a trunk which terminates in a head having a diameter greater than the diameter of the trunk. The length of each flange trunk is selected to be approximately equal to the thickness of the cap lip base portion 172, so only the heads of flanges 166 extend above the base portion 172. To insure a lasting fit, the cap retainer post 166 may be swaged over. The elastomeric material of the lip member 170 allows the material surrounding the mounting holes 174 to resiliently grip the trunk portion of the flanges 166 to hold the tip assembly 170 against the retainer 160. Extending upward from the lip base 172 is a lip member 175 which is sized to extend around the nozzles of the printheads 60–66 when making contact therewith during a capping step described further below. To prevent depriming the nozzles of printheads 60–66 during capping, the lip base 172 has a pair of vent holes 176 extending therethrough which aid to relieve pressure along both ends of a sealing chamber formed by the lip base 172, the lip 175 and the lower surface of the orifice plates of printheads 160–166 when capping. The vents 176 allow air to escape from this sealing chamber along the labyrinth vent path defined by surface 168 of the cap retainer 160.

The generic assembly 100 also includes a cover 180, here shown for the black cleaner unit 80. The cover 180 defines four upper ramps or cam surfaces 182 which cooperate with the cap ramps 110 of base unit 102 to clamp the cam followers 152 of the cap sled 150 therebetween for motion between uncapped and capped positions. The cover 180 also defines a cap opening 184, through which the lip member 170 moves to seal the printheads 60–66. The cover 180 also defines a spittoon opening or mouth 185, through which ink spit is delivered to the color spittoon absorber 124 for the color cleaner units 82–86, or to the interior of the open spittoon 108 for the black cleaner unit 30. The cover 180 also defines a black wiper opening 186, through which extends the wiper assembly 125 when mounted on the black wiper mounting wall 116 of base 102. It is apparent that the cover 180 may be easily modified to put a color wiper opening at location 188, so the wiper assembly 125 may extend therethrough when mounted to the color wiper wall 118 of base 102, as shown in FIG. 6.

The generic cleaner assembly 100 also includes a snout wiper 190 for cleaning a rearwardly facing vertical wall portion of the printheads 160–166, which leads up to electrical interconnect portion of pens 50–56, described in greater derail below with respect to FIG. 10. The snout wiper 190 includes a base portion 192 which is received within a snout wiper mounting groove 194 defined by cover 180. While the snout wiper 190 may have combined rounded and angular wiping edges as described above for wiper blades 126 and 128, blunt rectangular wiping edges are preferred since there is no need for the snout wiper to extract ink from the nozzles. The base cover 180 also includes a solvent applicator hood 195, which shields the extreme end of the solvent applicator wick 135 and the lip portion 140 of the wick spring 138 when assembled.

Figure 4:
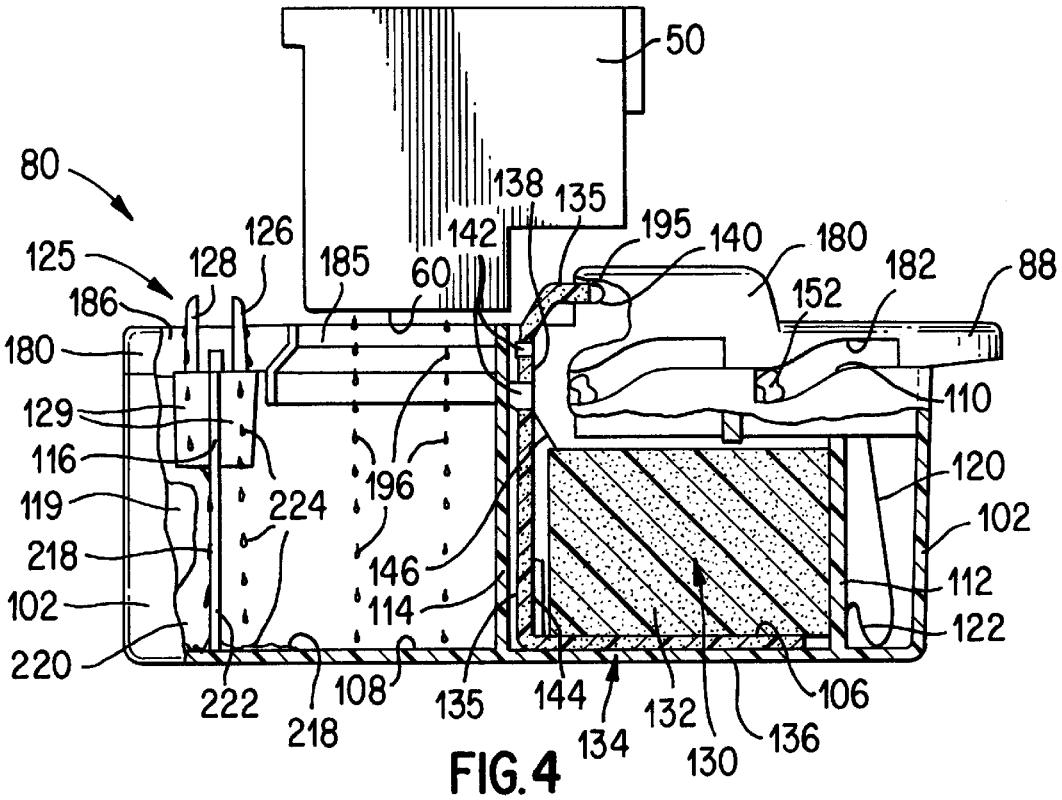
FIG. 4 is an enlarged, fragmented, side elevational view of a black printhead cleaner unit of the service station system of FIG. 1 showing a spittoon portion thereof ready to receive ink spit from a black printhead.
Figure 5:
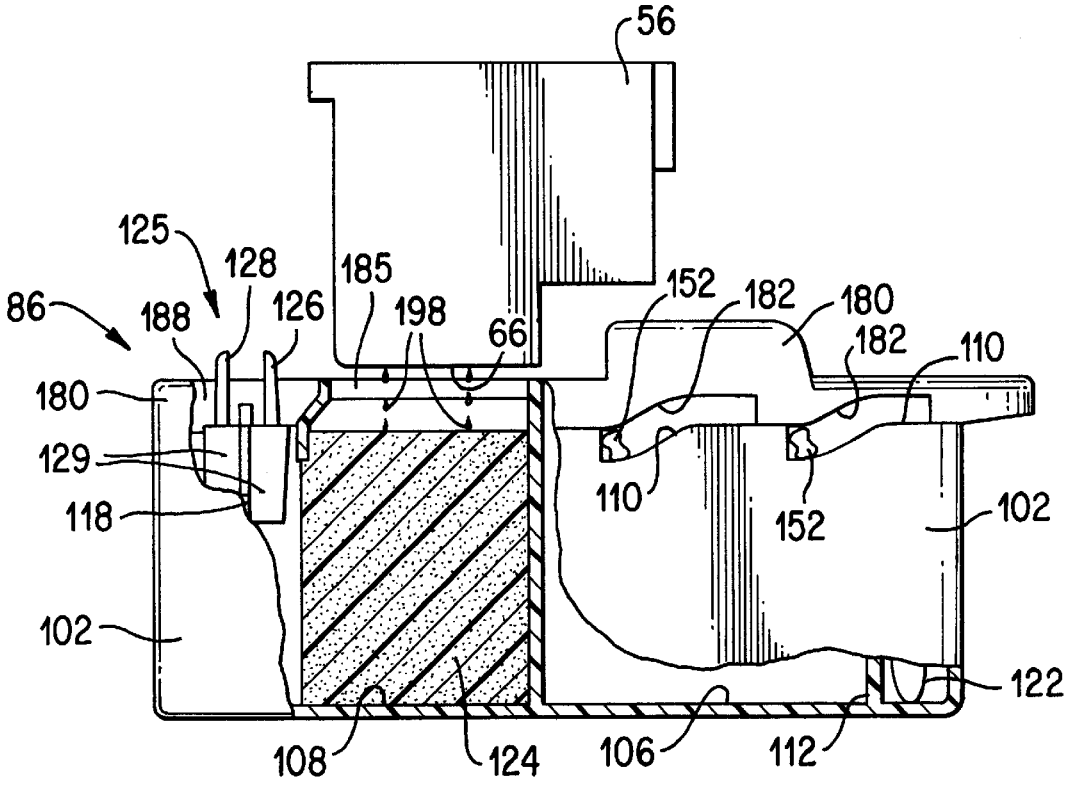
FIG. 5 is an enlarged, fragmented, side elevational view of a color printhead cleaner unit of the service station system of FIG. 1, shown with a spittoon portion thereof ready to receive ink spit from an associated color printhead of the printing mechanism.

FIGS. 4 and 5 illustrate the process of spitting to clear the printhead nozzles of any occlusions or blockages, with FIG. 4 showing the black pen 50 spitting ink droplets 196 into the bottom of spittoon 108, and FIG. 5 showing one of the color pens 56 spitting color ink droplets 198 onto the absorber 124. As mentioned briefly above, the spittoon 108 of the black printhead cleaner 80 has no absorber, allowing the viscous black ink residue 196 to accumulate along the bottom of the reservoir floor. The color ink 198 is absorbed into the pad 124, which collects the solids while allowing the volatiles within the color ink 198 to evaporate. The black pigment based ink 196 does not dry as rapidly as the color ink, and forms a sticky tar like residue, which is advantageously collected within the base of the spittoon 108 of the black printhead cleaner 80.

Figure 6:
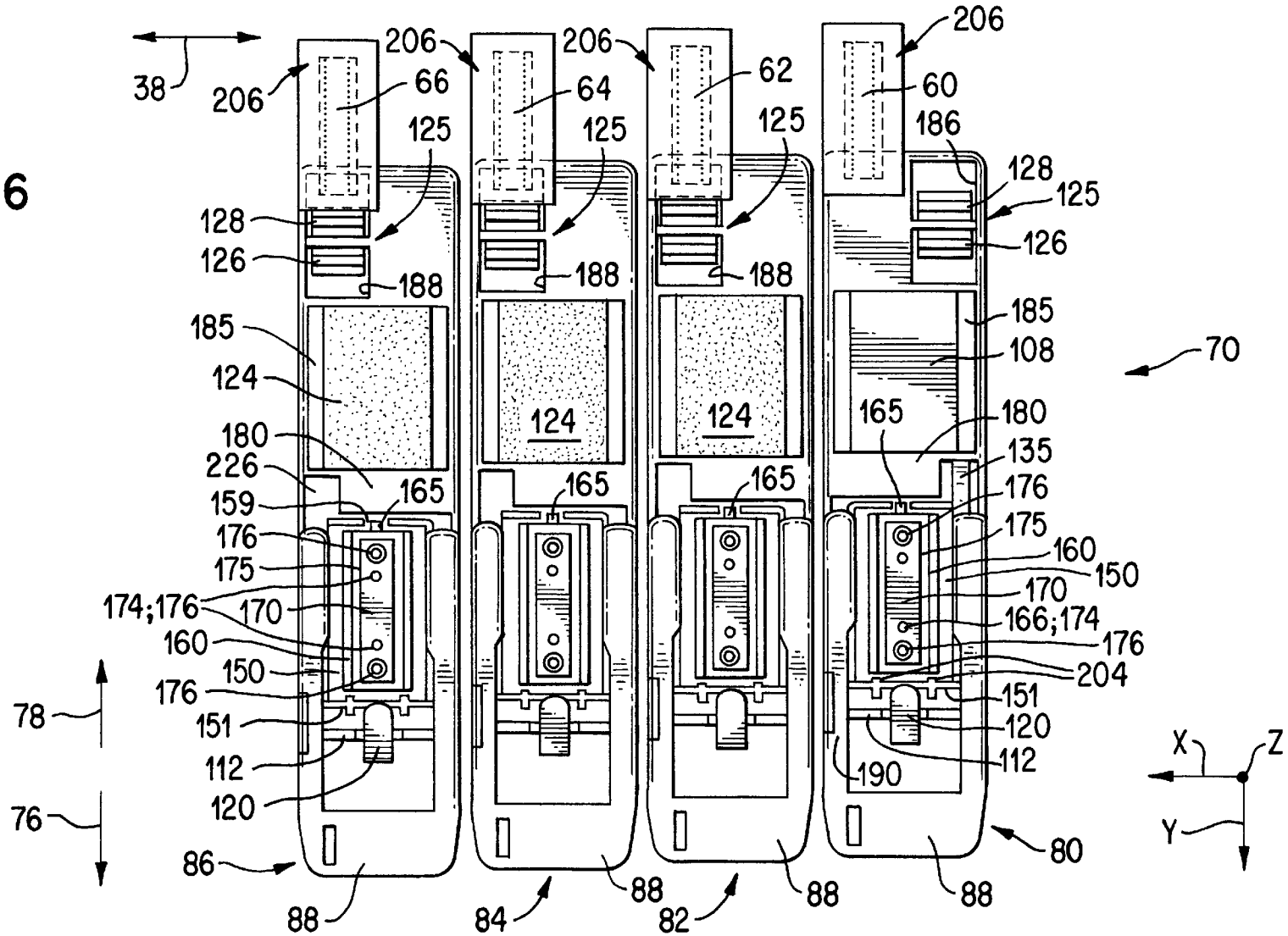
FIG. 6 is an enlarged top plan view of the replaceable service station system of FIG. 1 shown ready to begin wiping the color printheads.

FIG. 6 illustrates the position of the wiper assemblies 125 of the color cleaner units 82–86, just prior to the start of a wiping stroke where the pallet 72 (omitted for clarity from FIG. 6) moves the cleaner units in a rearward direction 78. To wipe the black printhead 60 with the wiper assembly 125 of the black cleaner 80, the carriage 40 is moved to the right in the view of FIG. 6, along the scanning axis 38 to align the black wipers with the black printhead. Offsetting the wipers of the color printhead cleaners 82–86 from the wiping location of the black printhead cleaner 80, advantageously allows for different wiping schemes to be employed for cleaning the color printheads 62–66 than from the methods used to clean the black printhead 60. While wiping both the color and black pens at the same speed is preferred in the illustrated embodiment, the ability to employ individual wiping schemes is particularly advantageous when using different types of ink for color and black printing.

For example, in some implementations it is advantageous to use a slower wiping speed for the black pigment based ink, which is less viscous than the color dye based inks. Too slow of a wiping stroke wicks excessive amounts of ink from the dye based color inkjet pens 52–56. This excess dye based ink eventually builds-up a residue on the wiper, leading to less effective wiping in the future, as well as other problems. Actually, a scrubbing type of wiping routine is preferred to clean the tar-like pigment ink residue from the black printhead 60. If simultaneous wiping of all of the printheads was required, with a faster wipe used to accommodate the dye based inks, the wiper for the pigment based ink would be prevented from making full contact with the ink residue. Instead, the wiper would skip over bumps formed from the tar-like pigment based ink residue in a jerking or stuttering type of motion, which would fail to remove the residue from the printhead. Offsetting the color wipers from the wiping location of the black wiper allows the service station 70 to separately tailor the wiping schemes used to clean the color printheads 62–66 than from those used to clean the black printhead 60.

Figure 7:
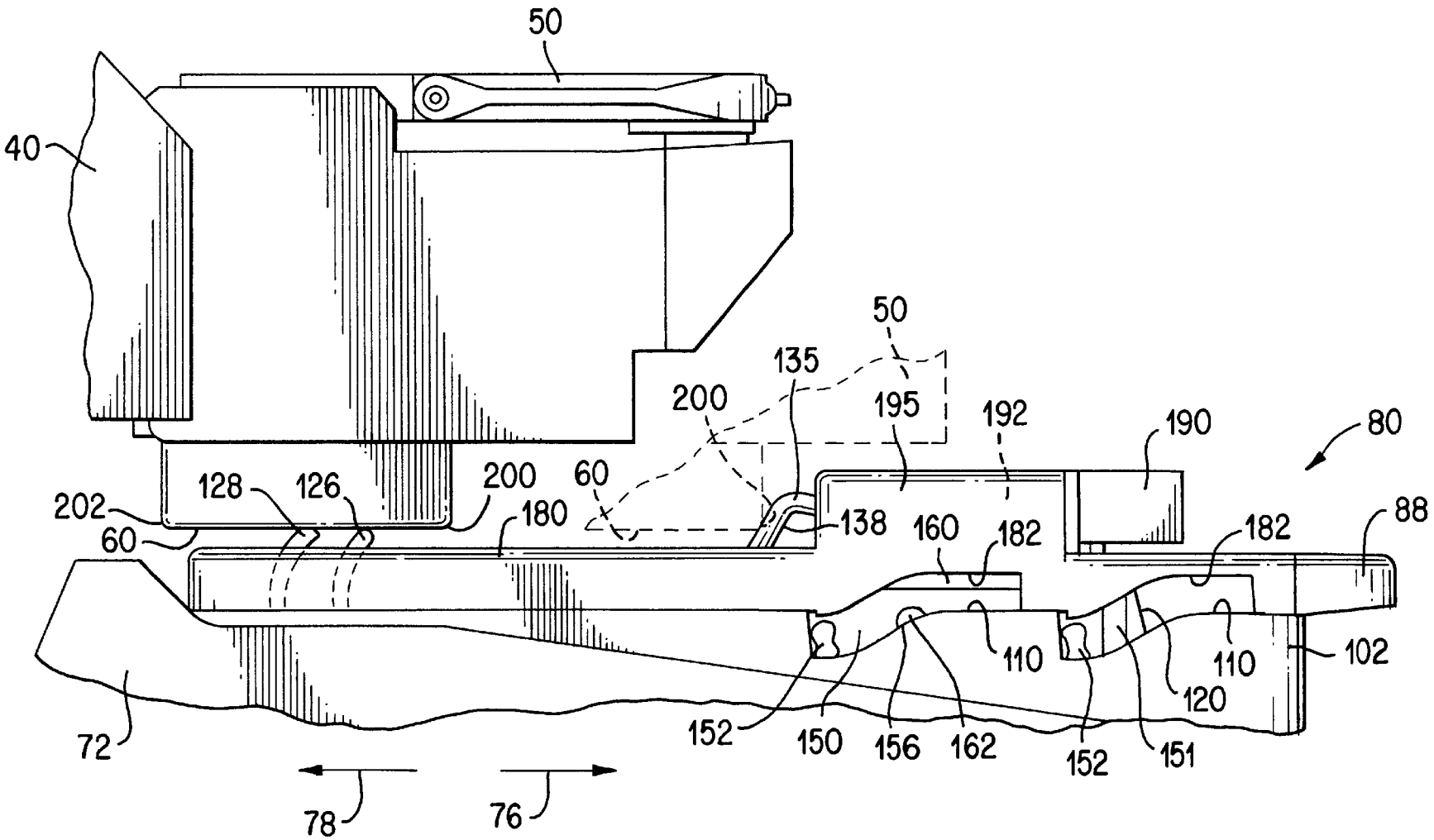
FIG. 7 is an enlarged side elevational view showing, the black printhead cleaner unit of FIG. 1 wiping, the black printhead in solid lines, and showing in dashed lines an applicator thereof applying an ink solvent to the black printhead.

FIG. 7 illustrates a wiping stroke, here with the wipers 126, 128 of the black cleaner 80 shown wiping the black printhead 60. During this stroke, the cleaner 80 is moving in the rearward direction 78, so the rounded exterior wiping edge of wiper blade 128 first contacts the printhead 60, followed by the angular interior wiping edge of blade 126. The rounded wiping edge of blade 128 is believed to wick or draw ink from the nozzles through capillary action, which acts as a solvent and lubricant during the wiping stroke, followed by the angular wiping edge along the interior of blade 126 which serves to remove any wicked ink and dissolved ink residue remaining on printhead 60, as described in the Hewlett-Packard Company's U.S. Pat. No. 5,614,930. The same wiping mechanism used to clean the black printhead 60 is also used to clean the color printheads 62–66, and indeed, it is apparent that given the symmetrical nature of blades 126, 123, a similar wiping stroke may be made in the forward direction 76, accomplishing the same results.

FIG. 7 also illustrates application of the ink solvent 130, here a polyethylene glycol ("PEG") 300 treatment fluid, to a front edge 200 of printhead 60. As mentioned in the background section above, the Hewlett-Packard Company's HP 2000C color inkjet printer also uses an ink solvent, but it differs from the system disclosed herein because the solvent system in the BP 2000C printer is a permanent part of the inkjet printing unit, whereas the black printhead cleaner 80 is replaceable. Moreover, in the HP 2000C printer, the ink solvent is applied first to a wiper, and then the wiper applies the solvent to the printhead, whereas the printhead cleaner 80 applies the solvent 130 directly to the leading edge 200 of the printhead 60, as shown in FIG. 7 in dashed lines.

Referring back to FIG. 4, the solvent reservoir block 132 is preferably constructed of a bonded nylon material, with the applicator member 134 being constructed of an open cell polyurethane foam, and the backing spring 140 being constructed of a sheet metal material. Using this system, approximately 0.5 mg (milligrams) of solvent 130 is applied to the printhead 60 per application. The solvent mainly serves to dissolve ink residue on the surface of the printhead, but also provides a secondary function of acting as a lubricant during the wiping strokes. PEG 300 is a preferred treatment fluid that assists the wiper in maintaining good nozzle health and orifice plate cleanliness throughout the life of the printhead. The solvent reservoir 132 and the applicator wick 138 are preferably sized to store together approximately 10 cc (cubic centimeters) of ink solvent 130, although in the illustrated embodiment, 8 cc of solvent 130 is an even more preferred amount.

As the leading edge 200 of the printhead 60 contacts the applicator 135, as shown in dashed lines in FIG. 7, fluid 130 is dispensed as the applicator wick 135 is compressed by the printhead. When the foam of the applicator wick 135 is compressed, the solvent 130 is pushed out of the cells of the foam and onto the printhead leading edge 200. The wick spring 138 is preferably formed with a preload, which provides a resistant force to support the foam of wick 135 when pushed against by the printhead 60. The fluid 130 is then distributed over the orifice plate by the wipers 126, 128 during a subsequent wiping stroke. Thus, each successive dispensing of the ink solvent 130 adds to an existing quantity of solvent already resident on the printhead 60 and wipers 126, 128 from previous applications. Preferably, an average of 0.2–0.8 mg of fluid is dispensed per application, with 0.5 mg being a normal application.

Furthermore, the ink solvent 130 acts as a non-stick film barrier on an interconnect side 202 of the printhead 60. During development studies, it was found that when too little of the fluid 130 is applied, ink residue builds up on the orifice plate 60, and when too much fluid 130 is applied, the excessive solvent 130 mixed with ink builds up on the pen, and can periodically drip onto a printed page. Moreover, too much fluid may also cause the solvent 130 to be sucked into the nozzles of the printhead 60, which can cause a pen printing problem requiring a time wait while performing a spitting routine to clear the PEG solvent 130 from the nozzles. Thus, application of a desired amount of fluid 130, not too much and not too little, became the challenge.

The applicator member 134 serves the functions of applying the solvent 130 to the printhead 60, and of transporting the fluid 130 from the reservoir block 132 to the applicator 135. The material chosen for the wick member 134 is selected to have a sufficiently high capillary pressure to overcome the capillary pressure of the reservoir block 132 and to provide for a vertical rise or fluid head to the point of application, as shown in dashed lines in FIG. 7. For instance, the steady state ascending capillary pressure of the applicator wick 135 is greater than 150 mm (millimeters) for the PEG 300 solvent 130. The material selected for the wick member 134 is self-wetting or hydrophilic, allowing the material to fill with fluid of its own volition once in contact with the reservoir block 132. Other physical properties of the wick member 134 are selected so that the foam applies the specified amount of fluid, here 0.2–0.8 milligrams, throughout the range of manufacturing tolerance variations that occur in the foam, as well as within the plotter 20. One of the main physical properties of the wick member 134 that affects the fluid dispensing use is the stiffness of the foam, with the main contributor to the stiffness being a compression factor, that is, the ratio of pre-felt to post-felt thickness of the foam, with the post-felt thickness being the primary contributor. Physical properties of the polyurethane based polymer also influence the stiffness of the foam of applicator member 134.

Another important component of the ink solvent dispensing system is the material selected for the fluid reservoir block 132, which is preferably a pultruded, bonded nylon fiber material, with a physical volume of 27 cc (cubic centimeters), and an absorption capacity for the PEG solvent 130 of 25 cc. The reservoir 132 is filled to a maximum of 50% capacity, to allow space for absorption of up to 50% water from the atmosphere in high humidity conditions. The ascending height capillary pressure of the fluid reservoir 132 is selected to be 30–40 mm (millimeters) for the PEG-300 solvent 130. This capillary pressure is selected to be sufficiently high, so that the PEG solvent 130 will not leak out of the reservoir 132 during transport, or if the cleaner unit 80 is placed on end, while also being sufficiently low to allow free release of the fluid 130 into the applicator wick member 134.

Another important component in implementing the ink solvent dispense system of printhead cleaner 80, is the wick spring 138. The wick spring 138 supports and locates the applicator wick 135, as described briefly above with respect to FIG. 3 The primary function of the wick spring 138 is to provide a known force so that the PEG solvent 130 is expelled from the applicator wick 135 when the applicator comes in contact with the printhead leading edge 200, as shown in dashed lines in FIG. 7.

Advantageously, by biasing the wick spring 138 with a preload, that is, with the wick spring 138 reclined in a rearward direction 78 from the mounting tab 144, creates a preload with approximately a constant spring force of around one Newton. This preload assures that the fluid dispense volume is consistent regardless of service station axis positioning accuracy and tolerance stack in assembling the plotter 20. For instance, in commercially produced printing units a typical printhead-to-cleaning unit spacing variation may be on the order of 2 to 4 mm (millimeters). Preloading the wick spring 138 advantageously minimizes variation in spring force resulting from either variation in the contact position of the applicator wick 135 with respect to the printhead leading edge 200, and from manufacturing variations in the wick spring 138 itself, such as variation in bend angles and the like.

Preferably, the wick spring 138 has an approximate 45° bend or ramp just prior to reaching the lip portion 140. This 45° inclined ramp ensures that the applicator wick 135 only touches the leading edge 200 of the printhead 60, regardless of the Z axis alignment of corner 200 relative to the applicator 135. Use of this ramp portion of the wick, which encounters the printhead leading edge 200 (FIG. 7—dashed lines) insures that the area of foam contact with the printhead 60 is constant regardless of the Z axis alignment of the assembled components for a consistent fluid application. Additionally, the preloaded spring force on the wick spring 138 serves to provide a constant Y axis spring force in the rearward direction 78, regardless of the vertical or Z axis positioning of the printhead 60 with respect to applicator 135. Thus, any misalignment in the Z axis has very little affect on the amount of fluid dispensed, since the surface area of contact between the inclined portion of the wick 135 and the leading edge 200 of printhead 60 is substantially constant, regardless of any Z axis misalignment therebetween.

A variety of advantages are realized using the ink solvent application system portion of the black printhead cleaner 80. For example, applying the ink solvent 130 with wick 135 increases the usable life of the black printhead 60, when compared to other printers which do not have an ink solvent system to facilitate successful wiping of long life printheads, such as permanent or semi-permanent printhead 60. Without an adequate coating of ink solvent 130, tests found that an orifice plate dispensing pigment based ink 196 would become encrusted with contamination, and eventually limit the useful life of the printhead. Additionally, the use of ink solvent 130 dissolves ink residue built up on the orifice plate, while also providing a non-stick fluid barrier which prevents additional ink residue from adhering to the orifice plate of printhead 60. Finally, the solvent 130 lubricates the wipers 126, 128 which decreases the wiper tangential force applied to the printhead, while also reducing wiper wear.

The use of an ink solvent 130 has also enabled the use of a wider variety of ink types, by eliminating wipability as a constraint to ink development. Use of new types of ink has resulted in a number of important customer benefits, related to the quality of the printed page, including the use of inks with (1) higher optical density, allowing (2) faster throughput (pages per minute), (3) better light fastness, (4) better smear fastness, (5) better water fastness, and (6) overall increased reliability. First, the use of black pigment based inks yields a higher optical density, which is directly related to the percentage of black pigment added to the ink vehicle. Indeed, during initial development of the black pigmented ink cartridges, the dye load was constrained by the wipability of the ink, with too much black pigment causing solid masses of black ink residue to build up on the orifice plate, which could not be removed by the earlier wiping systems then employed. Advantageously, the use of a PEG ink solvent 130 enables clean wiping of the orifice plate, even though dispensing ink 196 which has high concentrations of black pigment.

Second, achieving faster throughput, measured in pages per minute, requires that the inks are fast drying. However, fast drying inks tend to be difficult to wipe because they dry rapidly and adhere to the orifice plate 60 before the wiping stroke occurs. The use of the PEG ink solvent 130 advantageously redissolves the dried ink, allowing it to then be removed by subsequent wiping strokes.

Third, improved light fastness is found with the use of pigment based inks, in comparison to dye based inks, which are easier to service but are not often as lightfast as pigment based inks. From a servicing standpoint, the problem with pigment based inks is that they form solid masses on the orifice plate which are difficult to wipe, but this problem is solved by using the PEG solvent 130 which facilitates clean wiping of the orifice plate 60.

Fourth, regarding smear fastness, sticky polymer binders in inks may be used to improve smear fastness, but these binders often adhere to the orifice plate, as well as to fibers in the paper. Polymer binders are very difficult to wipe off of the orifice plate 60 without the use of an ink solvent 130. Thus, by using solvent 130, these polymer binders are no longer a problem.

Fifth, regarding water fastness, the use of both polymer binders and pigments in the black ink 196, both of which are inherently not soluble in water, improves the water fastness of the ink. Finally, regarding the enhanced reliability, the chemical stability of an ink affects the reliability of the entire pen, and without the use of an ink solvent, more organics are required in the ink composition to prevent ink crusting, especially since ink crust is one of the more difficult ink residue substances to remove from the printhead 60. Unfortunately, the addition of organics to an ink composition also contributes to pigment settling, clogged nozzles, and flocculation, all of which reduce the reliability of the ink. Thus, the use of an ink solvent 130 allows for less organics to be required in the ink composition, resulting in a higher ink reliability.

A variety of other advantages are realized using the fluid dispense system of the black printhead cleaner unit 80. For example, depending upon the particular implementation and types of printheads being cleaned, the amount of fluid can be tuned or adjusted during product development by a variety of different methods, including: changing the spring force of the wick spring 138 (e.g. by adjusting bend angles, using a different spring thickness, or a different spring geometry); by changing the foam geometry of the wick assembly 134; by changing the foam properties of the wick assembly 134 (e.g. the stiffness, the pores per inch, or the base foam material); by changing the material properties of the reservoir block 132 (e.g. density); or by changing the fill volume of the reservoir block 132. Thus, it is possible to tailor the amount of PEG ink solvent 130 dispensed from the applicator 135 to an optimal amount based on both expected printer usage and service station servicing routines.

Furthermore, use of the applicator wick 135 allows the solvent 130 to be dispensed using only one axis of motion in the printer, that is, to move the cleaning unit 80 rearwardly, as indicated by arrow 78 in FIG. 7. This single axis of motion system is far simpler than earlier solvent application systems, such as that used in the Hewlett-Packard Company's HP 2000C color inkjet printer which rotated and elevated the wipers for solvent application. Thus, use of the solvent wick applicator 135, in combination with the capping assembly 170 and cap sled 150,allows for single axis actuation of the replaceable service station 70, that is, through motion along the Y axis.

Another advantage of the illustrated solvent dispensing system is that storing the ink solvent 130 within the reservoir block 132 ensures that the fluid does not leak during shipping because the reservoir 132 provides a sufficiently high capillary pressure to retain all the fluid in all orientations when subjected to shipping environments, including varying temperature ranges, humidity ranges, shipping vibrations and the like. Furthermore, the use of a replaceable printhead cleaner 80 allows fresh ink solvent 130 to be replenished each time the cleaner unit 80 is replaced, so the reservoir need not carry an amount of fluid sufficient for the entire life of plotter 80, but only for the life span of the cleaner unit 80. Moreover, by containing the ink solvent 130 within the replaceable cleaner unit 80, a customer is not required to separately replenish or replace the fluid 130 during the life of the printing mechanism 20. Thus, replacement of the ink solvent 130 is an operation which is essentially transparent to the customer, allowing this replenishment without the customer needing to know or understand why they are replacing the cleaning fluid 130.

Figure 8:
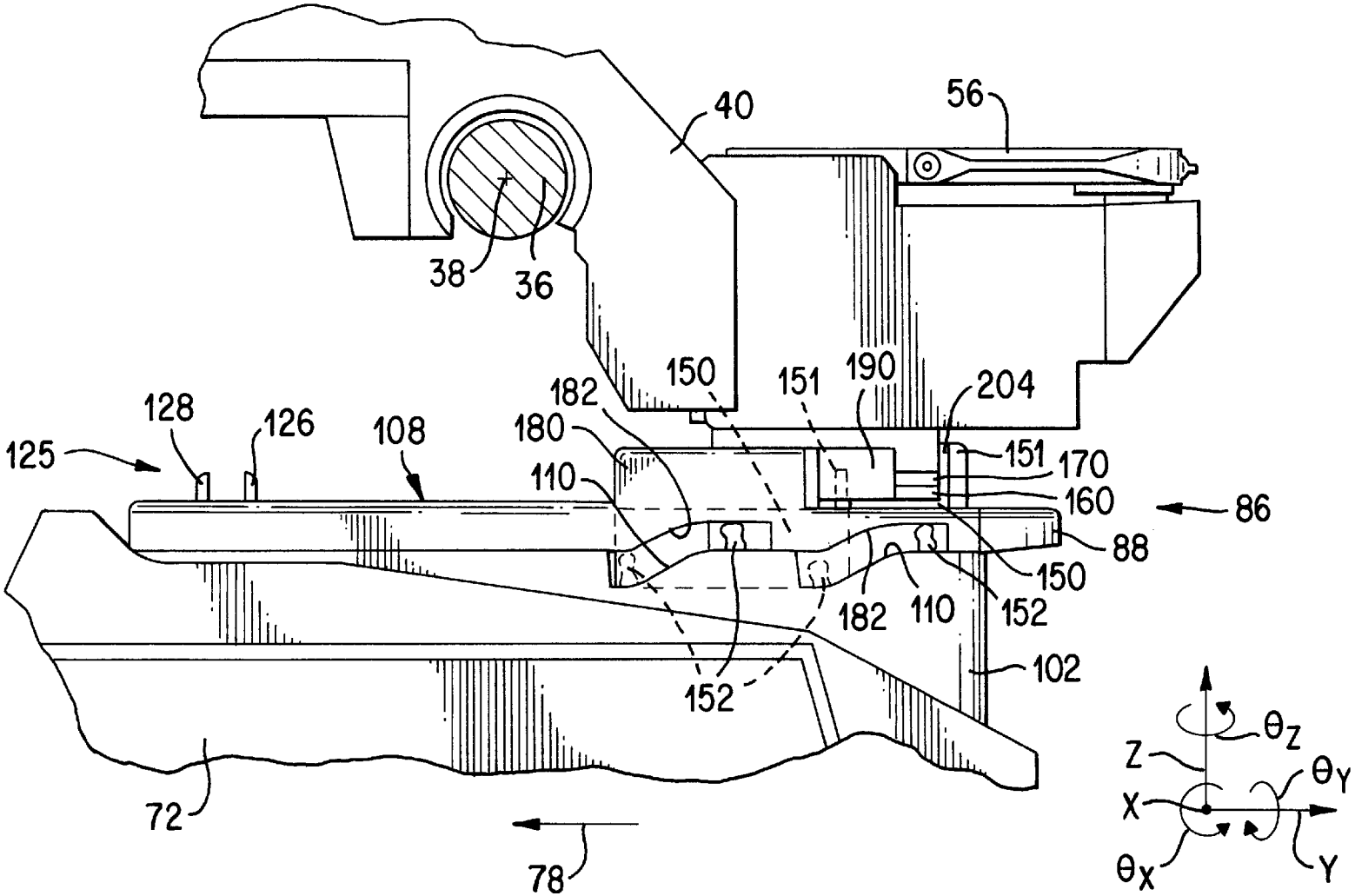
FIG. 8 is an enlarged side elevational view showing a color printhead cleaner unit of FIG. 1 capping an associated color printhead.

FIG. 8 shows the printhead capping routine, here illustrating the cyan printhead of pen 56 being capped by the cyan cleaning unit 86. Here, the service station pallet 72 has been moved in the rearward direction of arrow 78 until the actuation wall 151 of the cap sled 150 has contacted the forward facing surface of pen 56, at a point where the cam followers 152 are shown in dashed lines between the cam surfaces 110 and 182. Further rearward motion 78 elevates the cap sled 150 as the cam followers 152 move upward between cam surfaces 110 and 182, to reach the capped positions shown in solid lines in FIG. 8. Thus, the linear motion of the cleaner unit 86 is translated into vertical motion as the cap sled is elevated by the cam followers 152 traveling upwardly along cap ramps 110, 182. Use of the cam surfaces 110, 182 and cam followers 152 advantageously eliminates the need for two axis service station actuation because capping is achieved through pure linear motion of pallet 72, without requiring rotation or combinations of rotational and translating motion to achieve capping. Thus, the replaceable service station unit 70 requires only one motor 74 to achieve all the servicing functions, resulting in higher reliability and cost savings, as well as power savings for the ultimate consumer.

This capping mechanism of cleaner units 80–86 is quite different from the earlier replaceable printhead cleaners described in the background portion above, for the Hewlett-Packard DesignJet® 2500CP ink jet plotter. In this earlier system, cap actuation was achieved by lifting the entire replaceable service station unit into contact with an associated printhead, requiring two axes of actuation, that is, the service station had to move both vertically and horizontally to achieve capping. Unless, the replaceable cleaner units 80–86 are designed to achieve capping elevation through purely translational movement of the cleaner units.

The capping operation is quite important, because during periods of inactivity if an inkjet printhead is left open to the air, volatile components in the ink may evaporate out of the printhead nozzles. Thus, the use of elastomeric caps has come into practice for sealing the printheads to isolate them from ambient environmental conditions, including dust and contamination, when the printhead is not in use. By forming a seal on the printhead, the cap slows the loss of volatile ink components from the nozzles, while also maintaining a humid environment around the nozzles to prevent hard ink plugs from forming therein and blocking the nozzles. Furthermore, the use of a printhead cap 170 advantageously minimizes the occurrence of crusting, bearding and soft ink plugs so that a minimum number of drops are required to be spit into spittoons 108, 124 after wake up signal indicating an incoming print job has been received, which advantageously minimizes ink spent during the spitting process. Moreover, by preventing vapor loss out of the nozzles, the cap ensures that the concentration of volatiles in the ink resident in the pen does not decrease to an unacceptable level, thus maintaining proper concentrations of ink components within the pen for high quality printing during the lifespan of the pens 50–56.

While ramping mechanisms have been used to elevate caps before, typically this motion has occurred parallel to the printhead scanning axis 38, as the printhead and or carriage moved in the negative X axis direction to elevate the caps to a sealing position. Other capping sleds have been attached to a rotary tumbler (in the Hewlett-Packard Company's DeskJet® 800 series color inkjet printers), or through a translating or sliding motion (in the Hewlett-Packard DeskJet® 720C and 722C models of inkjet printers), with a portion of the sled contacting either the printhead or the printhead carriage so that further rotational motion or rearward motion in the Y direction elevates a bar linkage mechanism to achieve capping. However, to date, the illustrated printhead cleaners 80–86 are the first ones known to achieve capping through horizontal motion in a direction parallel to the linear nozzle arrays, and perpendicular to the scanning axis 38. Uncapping is then accomplished by moving the pallet 72 in the forward direction 76, allowing the cap sled return spring 120 to push on the activation wall 151 to force the cap sled 150 and cap 170 back down along the cap ramps 110, 182 to the rest position shown in dashed lines in FIG. 8. Moreover, the use of the cap sled return spring 120 advantageously allows capping to occur in a gradual steady motion as the pallet 72 moves rearwardly, so capping is achieved gradually to allow proper cap venting as described further below.

In commercial inkjet printing mechanisms, such as plotter 20, a variety of different parts are used to assemble the printer. Each part of an inkjet printing mechanism 20 varies in size within the tolerance specified on the engineering drawings, and as a result of various processing factors, such as cooling temperatures and the like for plastic and/or elastomeric molded parts which may vary from batch to batch. Variations in the geometry of each component is a normal part of all manufacturing processes. The tolerance variation of each part contributes to a tolerance stack or total variation in the distance over which a printhead cap must travel to adequately seal an inkjet printhead. Thus, the challenge becomes that of sufficiently ensuring a good alignment between the cap and the printhead in the presence of these various mechanical tolerance stacks. Moreover, both the pens 50–56 are replaceable in the carriage 40, and the cleaner units 80–86 are replaceable within the pallet 70, so when replaced, the new pens and cleaner units may vary in size from their predecessors. Thus, a variety of different physical impediments may exist which must be accommodated by the printhead cap to ensure adequate sealing, without applying excessive force to the printhead which may damage it.

If the cap sealing lip 175 is not accurately aligned with the printhead, then ambient air will leak into the cap resulting in excessive vapor loss from the pen. Typically, there is a limited target area or capping racetrack 206 on the printhead reserved for contact with the cap lip, as shown by the regions in FIG. 6 between the dashed lines and the perimeter of the orifice plates of printheads 60–66. To assure adequate sealing, the cap lip 175 must be aligned to the printhead in six orientations, or degrees of freedom, which together define a three dimensional space, that is, in the X, Y and Z axis directions, as well as in rotational orientation about each of these axes, denoted as θx, θy and θz.

In the replaceable servicing units 80–86, the cap sled 150 rides along, the cam surfaces 110, 182 to seal the printhead, as shown between the dashed line and solid line positions of FIG. 8. The cap lip 175 moves vertically upward and pushes against the orifice plate of the printhead as the cap sled 150 progresses up the cam surface. The rearward facing surface of the cap sled activation wall 151 has a pair of vertical alignment ribs 204, seen in top view in FIG. 6. In this system, the replaceable cleaning units 80–86 align the sled 150 directly to the printhead in the Y axis and with respect to the θz rotation. The gimbaling action provided by the cap spring 155, and the free floating nature of the cap retainer 160 with respect to sled 150, allows the cap lip and retainer to tilt and gimbal to align the cap to the printhead in the Z axis and with respect to rotation in the θx and θy directions. Thus, the capping system of the replaceable cleaning units 80–86 allows for closed loop alignment between the cap and the pen, so the cap can be positioned very accurately against the orifice plate. This self alignment routine achieved by the cleaning units 80–86 results in a small tolerance stack, so there is no need to cap over encapsulant beads, resulting in the reliable seal at a low capping force. Regarding alignment in the X direction, the cap lips 70 are wide enough to enable open loop alignment between the cap and the printhead in the X direction that is, there is adequate room along the racetrack 206 between each nozzle array and the edge of the printhead to allow some minor misalignment, without endangering sealing over the nozzles, and without increasing the overall width of the printing unit.

Thus, several advantages are realized using self aligning capping system of the replaceable cleaner units 80–86, including minimizing the tolerance stack in the X, Z, θx, θy, and θz orientations. Moreover, there is no need to cap over printhead encapsulant beads, so lower overall capping forces are employed. Additionally, the need for any special cap lip design for sealing over non-flat surfaces is totally eliminated. Furthermore, this capping system allows for a minimum gap between the end of the nozzle row and the edge of the pen, which allows for smaller margins on a printed page. Additionally, there is no need for precision tolerances on all of the service station, printhead and carriage components. Additionally, time consuming manufacturing line adjustments are not required, such as to orient the service station in the Z axis direction. Additionally, the service station cleaning units 80–86 do not need any type of electronics self-adjustments or separate calibrations, as were required in some previous inkjet printers.

Here, the cap vents are small air passages that relieve pressure from within a printhead sealing chamber defined between the cap base portion 172, the lip member 175, and the printhead orifice plate. The cap vents 176 prevent the nozzles from being subjected to a positive pressure air pulse as the cap seal lip 175 is compressed during capping, as well as during environmental changes. In the past, typically a single vent hole has been used to provide the service. However, the capping system of the replaceable cleaning units 80–86 uses a redundant cap vent system, having a pair of vent holes 176 which connect the sealing chamber to the retainer labyrinth path surface 168, which defines passageways leading from the vent holes 176 to atmosphere. Using a pair of redundant vent holes 176 allows the cap vent feature to function even if one vent hole becomes clogged with ink, for example if ink were flicked by one of the wiper blades 126 or 128 into one of the vent holes 176 the remaining vent hole continues to function. Single vent holes may also be clogged from ink dripping down from the orifice plate when sealed, thus the use of the redundant vent holes 176 facilitates venting should one of the vent holes become clogged.

The labyrinth vent channels or grooves defined by surface 168 of the cap retainer 160 are sized to prevent pressure differentials from forming during capping actuation, while still creating a resistive path to vapor diffusion when the printhead is sealed. Besides the use of channels or grooves on the labyrinth surface 168, elevated beads may also be used to define these vent paths. The exact sizing and orientation of the labyrinth vent path in the cap retainer will vary depending upon the size of the sealing chamber, the number of printhead nozzles, chemical properties of the inks, and the desired venting versus vapor diffusion characteristic selected for the particular inkjet printhead and printing mechanism.

Thus, use of the pair of redundant vent holes 176 with the labyrinth vent passageway to atmosphere advantageously eliminates a pressure pulse during the capping process, while also allowing the vent system to function correctly, even if one of the two vent holes becomes clogged.

Figure 9:
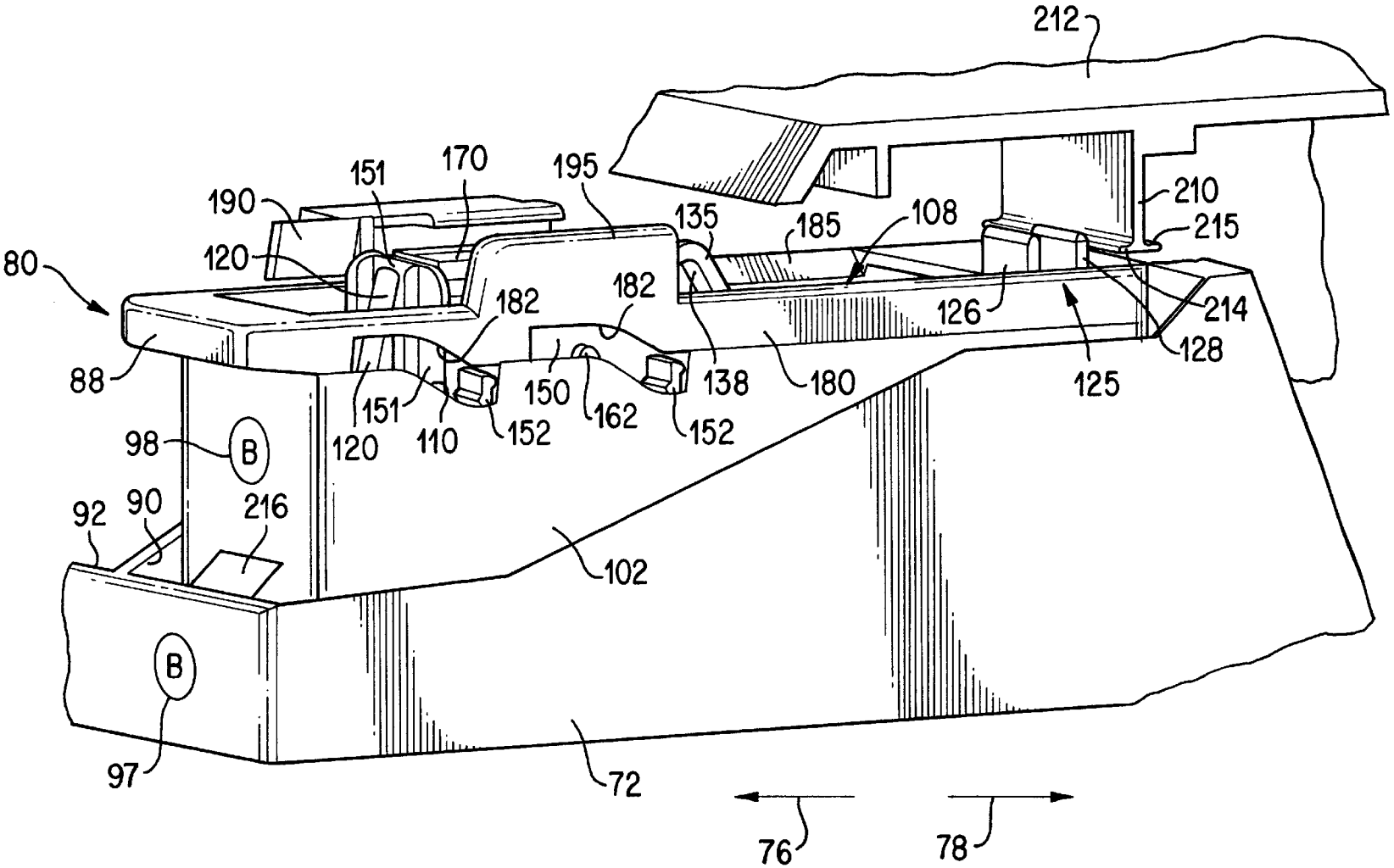
FIG. 9 is an enlarged perspective view showing a wiper portion of the black printhead cleaner unit of FIG. 1 just prior to scraping ink residue from the wiper portion.

FIG. 9 shows an optional operation of scraping the wipers 126, 128, here for the black printhead cleaning unit 80. The wiper assembly 125 is shown moving in the rearward direction 78 into contact with a wiper scraper 210. The scraper 210 extends downwardly from an interior surface of an upper stationary wall or hood 212, which forms part of the frame of service station 70. The scraper 210 is preferably an inverted T-shaped member, having a front wiping edge 214, which is engaged when the wipers move in the rearward direction 78, and a rear wiping edge 215, which encounters and removes debris from the wipers after passing under assembly 200, when then moving in the forward direction 76. Also shown in the view of FIG. 9 is a retaining tab member 16, which forms a portion of the pallet 72. The tab 216 rests against a pair of protrusions 217 (see FIG. 3) extending from the exterior of the base 102, and serves to positively secure the printhead cleaning unit, here unit 80, within stall 90 of pallet 72. The color stalls 92, 94, 96 are also equipped with similar retaining members 216 to secure the respective cleaning units 82, 84 and 86 therein.

The scraping step illustrated in FIG. 9 may be considered an optional step if amounts of ink solvent 130 in excess of those described above are applied to not only the black printhead 60, but also to the color printheads 62–64. As mentioned above, the amount of ink solvent 130 applied by wick 135 may be easily varied by changing the contours and dimensions, and material properties of the reservoir block 132, the wick base 136 and the wick member 135 to increase the amount of solvent applied to the printheads. Indeed, experiments were conducted with respect to the black printhead 60, where an increased amount of fluid 130 was applied to the printhead by increasing the frequency of solvent application, resulting in a scraperless inkjet ink solvent application system, as illustrated in FIG. 4.

It was found that an accumulation of the solvent 130 and ink residue on the wipers runs downwardly under the force of gravity along the wipers and into an auxiliary wiper chamber 220 defined by the base 102, as shown in FIG. 4 by the droplets of ink solvent and ink residue mixture 218. This solvent and ink residue mixture 218 may then flow through an opening 22 defined by the black wiper mounting wall 116 into the main spittoon 108. It is apparent that similar modifications may be made to the color cleaning units 82–86, with the inclusion of the ink solvent applicator wick 135 and reservoir block 132 underneath each capping assembly, inside the chamber 106. Similarly, the color wiper wall 118 may be modified with an opening similar to opening 222, to allow the combination of ink residue and PEG to drip down from the color wipers for absorption into the spittoon pad 124. Of course, it is also apparent that in such a scraper system, it may be desirable to line the bottom portion of the black spittoon 108 with an absorbent material, such as a smaller version of absorber 124, to assist in absorbing this additional flow of ink solvent 130 and ink residue, 218, 224 dripping from the respective wipers 128, 126.

Thus, a variety of advantages are associated with using the gravity drip method for cleaning the wipers through use of an additional amount of ink solvent, as shown in FIG. 4. For example, by eliminating the wiper scraper 210, the stationary portion of 212 of service station frame is simplified, not only in construction, but also in the manner in which it may be molded. Moreover, using this gravity drip method allows the wiper assembly 125 to be self cleaning, which eliminates the servicing time required for the scraping step shown in FIG. 9 so less time is required for printhead servicing. Additionally, wiper scrapers have been used in other inkjet printing units, such as Hewlett-Packard Company's DeskJet® 800 series, 700 series and HP 2000C models of inkjet printers. When scraping in these earlier devices, ink residue was thrown from the wipers blades after passing under the scraper, with this flying ink often landing in undesirable locations. Thus, use of the gravity drip method for cleaning the wipers shown in FIG. 4 may not only have the advantages of simplifying part construction and speeding service, but may also increase reliability of the replaceable service station 70.

Moreover, the elimination of a wiper scraper 210 may be particularly useful if different types of inks are used interchangeably within the same carrier portion of the printhead carriage 40. Thus, if the wiper scrapers are eliminated, there can be no cross contamination of one type of ink with another type of ink at the wiper scrapers when the ink cartridges are exchanged. The need for a separate wiper scraper increases the complexity of the service station, such as in the Hewlett-Packard Company's HP 2000C color inkjet printer which requires two motors to apply the solvent to the wipers, then to wipe the solvent along the printheads, followed by scraping the wipers on a stationary scraper. Other wiper scrapers have been also designed as a permanent part of the service station, such as in the Hewlett-Packard Company's: DeskJet® 700 series and 800 series inkjet printers; DesignJet® 600 series, 700 series, and 800 series inkjet plotters; DesignJet® 2500CP inkjet plotter; and the HP 2000C printer. Other wiper scrapers have been designed as a part of the pen itself, which unfortunately accumulates residue during printing, leading to fiber tracking and other print defects. Indeed, even on systems with replaceable service stations which employ a scraper permanently mounted to the service station frame, upon replacement of the service station modules, the new wipers become contaminated with residue remaining on the scraper from cleaning the wipers of the previous cleaner module. Thus, in some implementations the use of a separate wiper scraper 210 becomes an optional feature, rather than a necessity as in earlier printer designs, when an ink solvent 130 is used, particularly when applied using the wick applicator 135.

Figure 10:
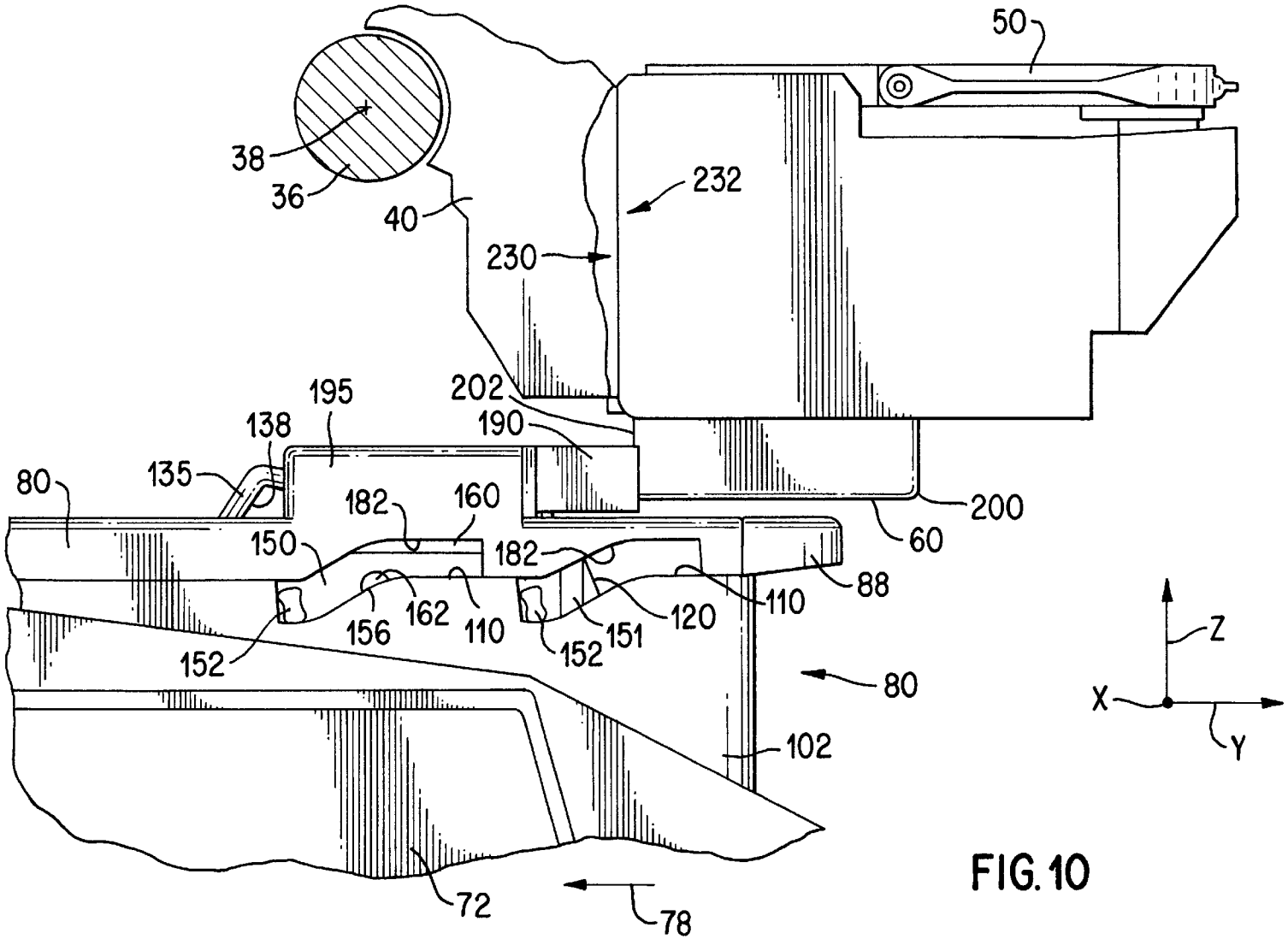
FIG. 10 is an enlarged side elevational view of the black printhead cleaner unit of FIG. 1 shown wiping a snout portion of the black printhead.

FIG. 10 illustrates the final operation of the printhead cleaning units 80–86, where the pallet 72 has moved rearwardly in the direction of arrow 78 until the snout wipers 190 are in interference contact with the interconnect face 202 of their respective printheads, such as printhead 60. Once in wiping contact, the pallet 72 remains stationary while the printhead carriage 40 is reciprocated back and forth along the X axis direction, which is also along scanning axis 38. This snout wiping step removes unwanted ink residue and any ink solvent 130 remaining on this portion of the pen. The snout portion of the printhead communicates electric signals between the firing resistors and an electrical interconnect portion 230 of the pen 50. The pen interconnect 230 receives signals from the controller 30 via a mating interconnect portion,232 of the carriage 40, with each of the interconnect portions 230 and 232 forming a mechanical/electrical interconnect between the pens 50–56 and carriage 40. Any ink residue or liquid solvent 130 remaining on the snout portion 202 could migrate upwardly, through capillary forces, or through removal and replacement of the pen by the consumer,, and cause a short circuit between the interconnects 230, 232, resulting in potential pen failure, or failure of some of the nozzles, which yields print defects.

In the past, snout wipers have been used in the Hewlett-Packard Company's DesignJet® 2000 and 2500 models of inkjet plotters. While other interconnect wipers have been proposed, these have typically been either fixed wipers located on a stationary portion of the service station frame, as in the DesignJet® units mentioned, or a wiper fixed to the printhead carriage. In either case, these interconnect snout wipers were permanent parts of the inkjet printing unit, and thus could only be replaced with a service call. Indeed, a further disadvantage of the snout wipers in the DesignJet® units was that the same wiper was used to wipe all four pens, which could lead to cross contamination of the inks, which may then accidentally be wiped from the interconnect over the nozzle plate by the wipers.

Thus, a significant advantage of the snout wiper 190 on cleaning units 80–36 is that the snout wipers are replaced each time the cleaning units 80–36 are replaced. Moreover, using a separate snout wiper 190 for each printhead 60–66 eliminates any possibility of cross contamination of inks. Additionally, use of the snout wipers 190 prevents the ink residue and ink solvent 130 from accumulating along the interconnect portions 202 of printheads 60–66, which, without the snout wipers 190, may eventually build up and drop under the weight of gravity onto media during a print job, ruining the print job. Additionally, use of the snout wipers 190 removes some of the ink residue from the printhead which would otherwise be removed by the wiper assembly 125 and in the case of a fixed wiper scraper as shown in FIG. 9 accumulated thereon. Thus, use of the snout wipers 190 prevents excessive ink buildup on the scraper 210. Preferably, the snout wiper 190 is constructed of the same material as described above for the wiper assembly 125, although other resilient materials may be more preferable in some implementations. Moreover, besides just removing waste ink and ink solvent, the snout wiper also removes any ink aerosol, which are floating airborne ink particles that are generated during drop ejection and fail to impact either the print media or the spittoons 108, 124.

Figure 11:
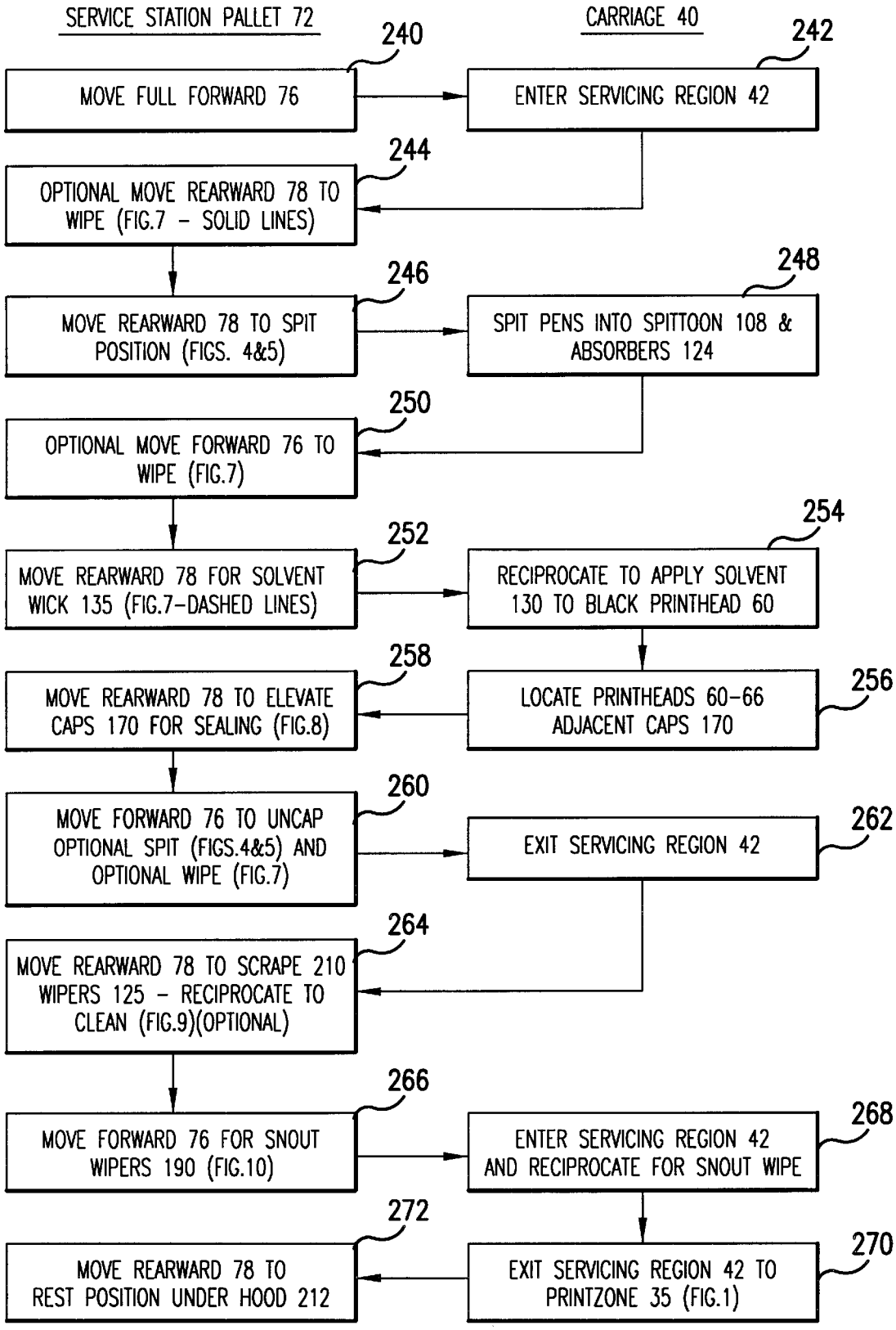
FIG. 11 is a flow chart illustrating one method of servicing printheads using the replaceable service station system of FIG. 1.

FIG. 11 is a flow diagram illustrating one manner of operating the replaceable service station 70 to service the printheads 60–66 installed in carriage 40. In the flow diagram of FIG. 11, the blocks in the left column all refer to motion of the service station pallet 72, while the blocks in the right column all refer to motion of the printhead carriage 40 along the scanning axis 38. Motion of both the service station pallet 72 and the carriage 40 are in response to control signals received from the plotter controller 30. Here, the servicing routine begins following completion of a print job, with the carriage 40 being located in the printzone 35. In a first step 240, the service station pallet 72 is moved in direction 76 to a full forward position, indicated in FIG. 11 as "forward 76," whereas rearward motion in FIG. 11 is indicated as "rearward 78," both referring to arrows 76 and 78 in the drawing figures. The first step 240 is followed by step 242 where carriage 40 enters the servicing region 42.

Once in the servicing region 42, the service station pallet 7 may perform the optional step 244 of moving rearward 78 to wipe the printheads, as shown solid lines in FIG. 7. The references to wiping in the flow chart of FIG. 11 just refer to FIG. 7, although it is implied that wiping is shown in solid lines in FIG. 7 from step 244. Following the optional step 244, or if not performed then following step 242, is another step 246 where the service station pallet 72 is moved in the rearward direction 78 to a spit position, as shown in FIGS. 4 and 5 for the black and color printheads, respectively. In step 248, it is assumed that the carriage 40 has positioned the printheads 60–66 over the respective spittoon 108 and absorbers 124, so the pens then spit black ink 196 and color ink 198 as shown in FIGS. 4 and 5, respectively.

Following the spitting step, the service station pallet 72 may take the optional step 250 of moving in the forward direction 76 to wipe the printheads clean of any ink residue, as shown in solid lines in FIG. 7. Following this optional wiping step, the service station pallet 72 then moves in the rearward direction 78 in step 252, until the solvent wick 135 is in the dashed line position of FIG. 7. In this position, with the wick 135 pressing against the black printhead 60, step 254 is performed where the carriage 40 may reciprocate the black printhead 60 gently back and forth along the scan axis 38 to wick additional solvent 130 from applicator 135, for application on the leading edge 200 of the printhead.

Following the solvent application step 254, the wiping step 250 may optionally be repeated. After this, the carriage 40 then locates the printheads 60–66 in step 256 adjacent the caps 170, where the sled actuator 150 and cam followers 152 are shown in dashed lines in FIG. 8. Following step 256, the service station pallet 72 then moves in the rearward direction 78 in step 258 to elevate the caps 170 or sealing, as shown by the transition of the cap sled from the dashed line position in FIG. 8 to the solid line position. Following the sealing or capping step 258, to ready the printheads 60–66 for printing, step 260 is performed, where the service station pallet 72 moves in the forward direction 76 to uncap the printheads. As a portion of this uncapping step 260, optionally the printheads may be spit as described above with respect to the spitting step 248, as shown in FIGS. 4 and 5, and this spitting may be followed by an optional wiping step such as steps 244, 250, as shown in solid lines in FIG. 7.

Following the uncapping step 260, the carriage 40 may momentarily exit the servicing region 242 in step 262, and enter the printzone 35, allowing the pallet 72 to move rearward in step 264. Step 264 is a scraping step, where the pallet 72 moves the printhead wiper assemblies 125 so the scraper 210 can clean the wipers 125 by reciprocating the service station pallet in the forward and backward directions 76, 78, as shown in FIG. 9. As mentioned before, the scraping step 264 is an optional step if ink solvent is applied by applicators 135 to all of the printheads 60–66 using the gravity drip method to clean the wipers, as illustrated in FIG. 4. In a snout wiping step 266, the service station pallet 72 moves in the forward direction 76 to position the snout wipers 190 as showy in FIG. 10. Following the snout positioning step 266, the carriage 40 then re-enters the servicing region 42 in step 268 and reciprocates back and forth along the scanning axis 38 for a snout wiping step. Following the snout wiping step 268, is an exiting step 270, where the carriage 40 again exits the servicing region 42 to enter the printzone 35, as shown in FIG. 1 to perform a print job. Following, the exiting step 270, in step 272 the service station pallet 72 is moved in the rearward direction 78 to a rest position underneath the stationary service station hood 212, which concludes the servicing routine.

Thus, a variety of advantages are realized by using the replaceable service station 70, including the ability to replace the printhead cleaning units 80–86 over the life of the printing, mechanism 20. In discussing the various components and sub-systems of the cleaning units 80–86, various advantages have been noted above. Moreover, from a discussion of the servicing routine with the respect to the flowchart of FIG. 11, it is apparent that a method of servicing an inkjet printhead, including wiping steps such as 244, spitting steps 248, solvent application steps 254, capping steps 258, uncapping step 260, scraping step 264 and snout wiping step 266, have been described in full above, with the method of FIG. 11 also disclosing several optional steps and variations which may be performed in specific implementations. Moreover, two alternate manners of cleaning the wipers 125 have also been shown, one with respect to FIG. 10 where ink residue is scrapped from the wipers, and an alternate gravity drip method described with respect to FIG. 4, where the scraper 210 becomes unnecessary. Also, FIGS. 2 and 6 exemplify the offset wiper components which enable independent servicing schemes for different groupings of printheads such as, for example, different ink types or different nozzle configurations.

In addition to such specific service station embodiments already described, other combinations of printheads may need customized groupings for servicing, or even individual independent servicing. This is true because some servicing actions applied excessively can be harmful instead of beneficial. Some service actions for particular printheads could require different parameters (speed, force, cycles, pressure, . . . ) depending on pen architecture, ink type, plot usage (monochrome versus color), etc. When recovering pens it is preferable to treat only the pens or nozzle arrays that show damage, not all the healthy pens. So the more servicing variables we could control independently, the better control over the life and quality of the printheads.

When designing a service station mechanism, it is often difficult to completely isolate each variable, and some of them have to be linked in order to simplify the mechanism, reduce cost, and reduce the size of the service station components. When designing a replaceable service station, the cost and size constraints become much more important.

Independent wiping by color or other grouping can be achieved simply by increasing the lateral pen to pen distance until a wiper can pass in between two pens without touching them (depending on system dimension tolerances). Then, we off-center the wipers so that the position of the wiper (left, right) will determine if a particular nozzle array sets wiped when aligning the printheads with this wiper location.

Figure 12A:
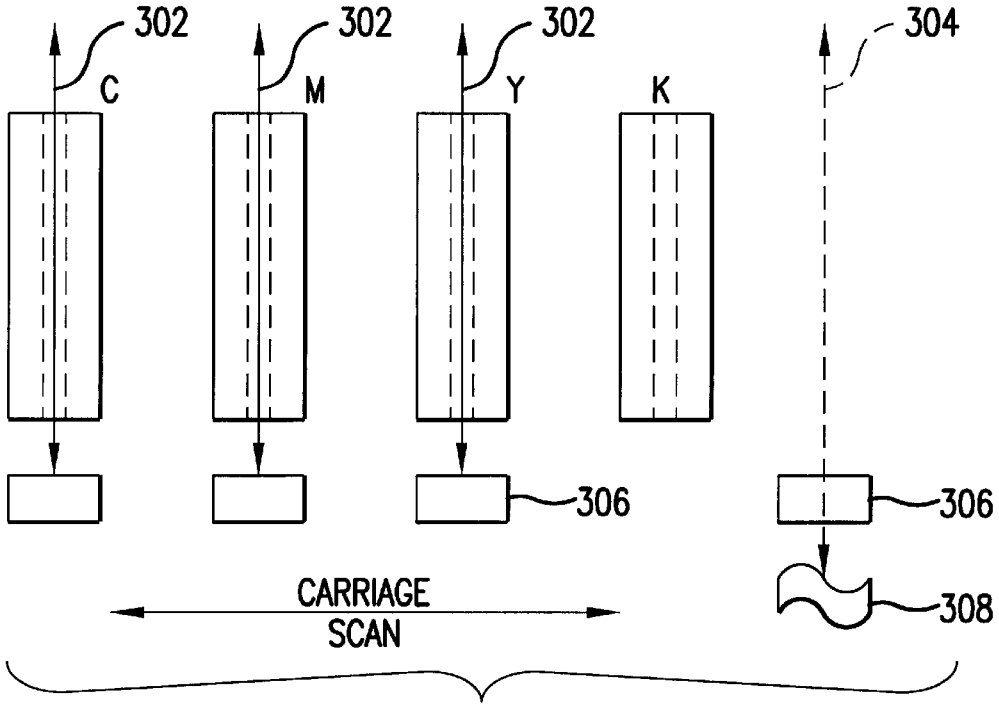
FIG. 12A shows a schematic representation of the color ink servicing mode of FIG. 2.
Figure 12B:
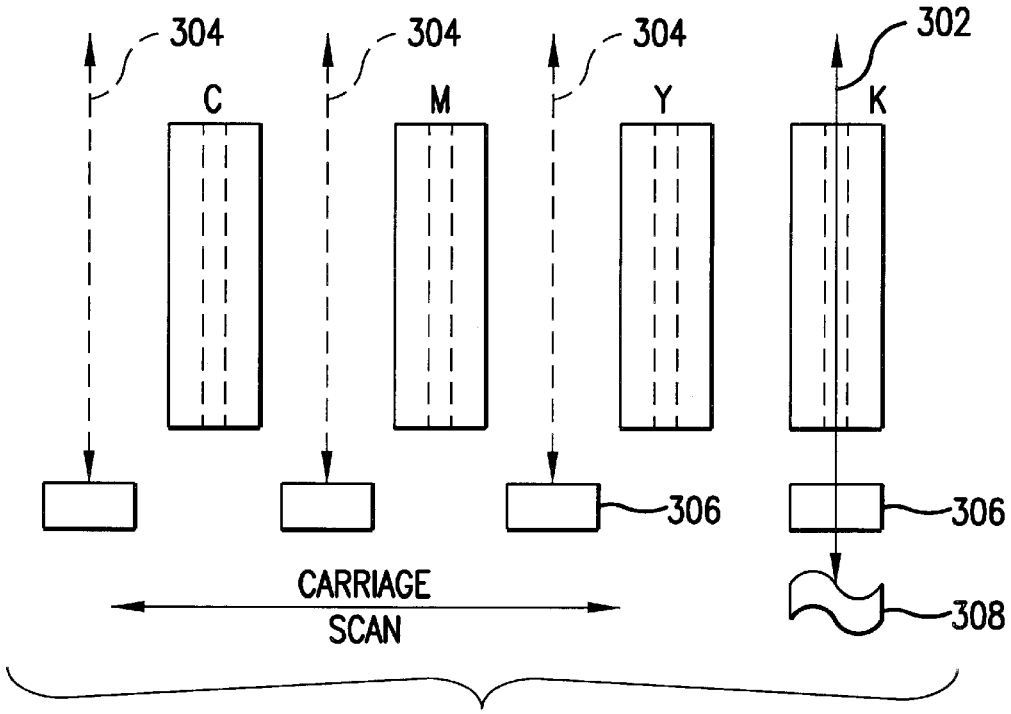
FIG. 12B shows a schematic representation of a black ink servicing mode as an alternative to FIG. 12A.
Figure 13B:
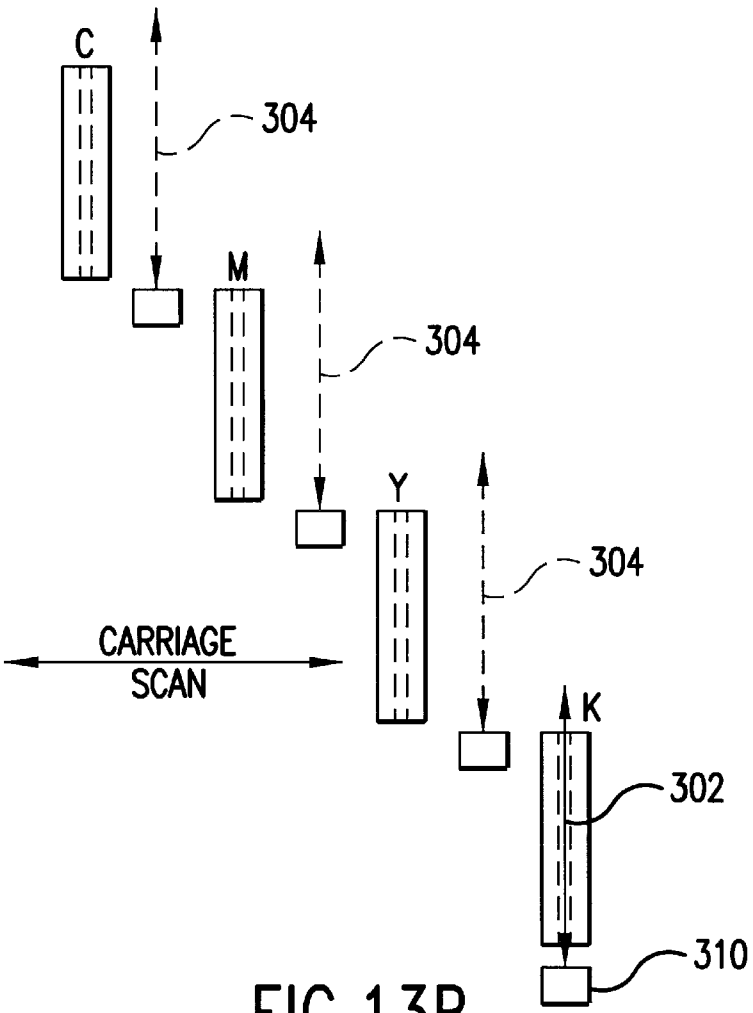
FIGS. 13A and 13B schematically show color and black ink servicing modes respectively for staggered printheads.

In the schematic of FIG. 12A, we can see that if we put the three first wipers to the left, the right most pen will not be wiped when aligning the pens with the left wiper location. The opposite (wiping only the right most pen) can be achieved by aligning the pens with the right most location as shown in FIG. 12B. This arrangement also works with pens that are partially overlapping or completely staggered as shown in FIGS. 11A and 13B.

As can be seen, the benefits of this invention include simplicity since there are no extra moving parts, no complicated mechanisms to hide wipers, and flexibility. This results in a low cost solution which is fast. There is no mechanism actuation, only position alignment indexing with the pen carriage and its printhead nozzle arrays. It is also a versatile solution. By simply changing wiper positions relative to the nozzle arrays, we can decide which pen gets wiped. If, for example, we want to create two groups (K and M require much more wiping than Cyan and yellow), we will put K and M wipers on the right, and Y and C on the left, so we can wipe them independently.

The same concept is used for the PEG dispense mechanism, where you can choose in the preferred embodiment between K and CMY for customized independent dispensing. The lateral pen to pen distance needs to be increased from 24 mm to 32 mm (50%) but this increase also has advantages.

This bigger pen to pen distance allows room to include some additional mechanisms on the printhead cleaner unit enabling the use of only one motor in the service station. Printhead cleaner units are much more compact while being able to hold the same quantity of waste ink. By having the pens more separated, cross contamination (ink aerosol traveling from one pen to another) is minimized. Now there is better usability because with 24 mm spacing the pens were too close to grab them without touching the neighboring pens.

It will be understood by those skilled in the art that the foregoing system creates the capability to split some servicing functions between two or more groups of printheads. This means that if a printer has N printheads, we can easily select which of them will belong to the first group and which of them will belong to the second group (or third group or fourth group, etc.) and those groups will be serviced independently (See FIGS. 14–17). Also, a pen can belong to one or more of those groups at the same time. (See FIGS. 14A–B and 17A–C). We have applied that grouping to the wiping and PEG (polyethileneglycol) dispensing servicing actions. This servicing grouping can also be applied to other servicing functions, such as priming, which require close interaction with the printhead or its nozzle arrays. The preferred embodiment is simple since the service station motion as a unit is linear (one degree of freedom only), and it moves more or less perpendicular to the printhead carriage motion. Servicing action is achieved by aligning the printheads with the component such as wipers in the scan axis direction and then moving the service station to rub the wiper against the pens in a forward and/or reverse direction.

Figure 13A:
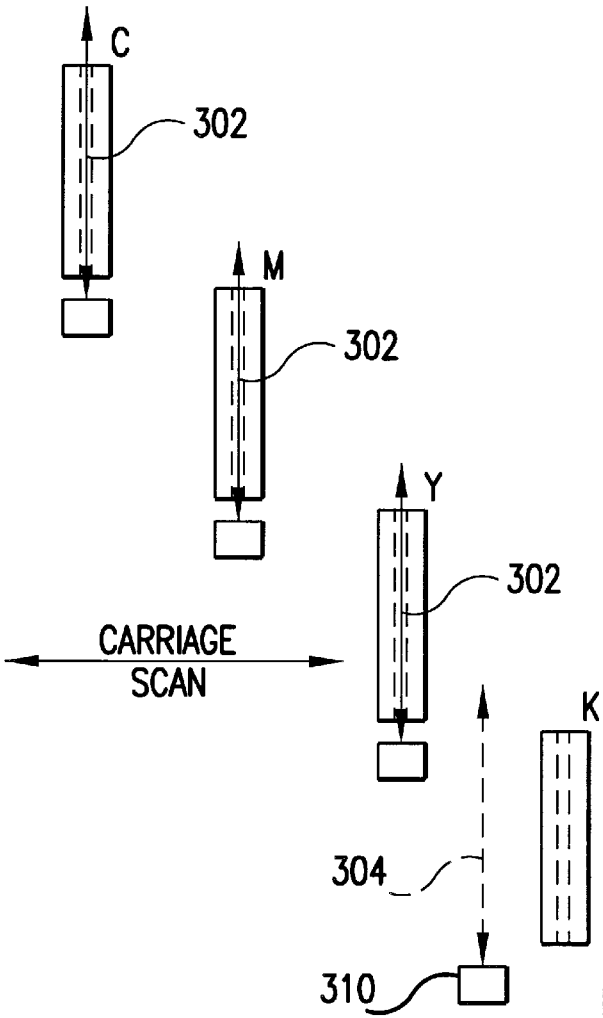
Figure 14B:
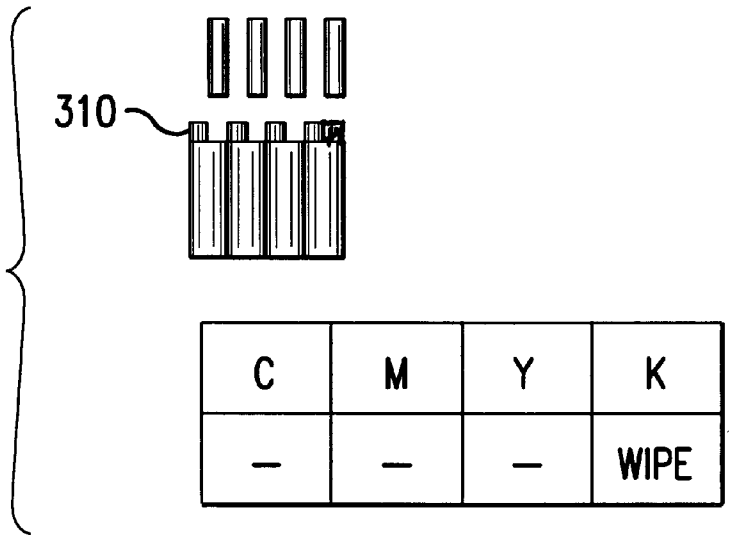
Figure 14A:
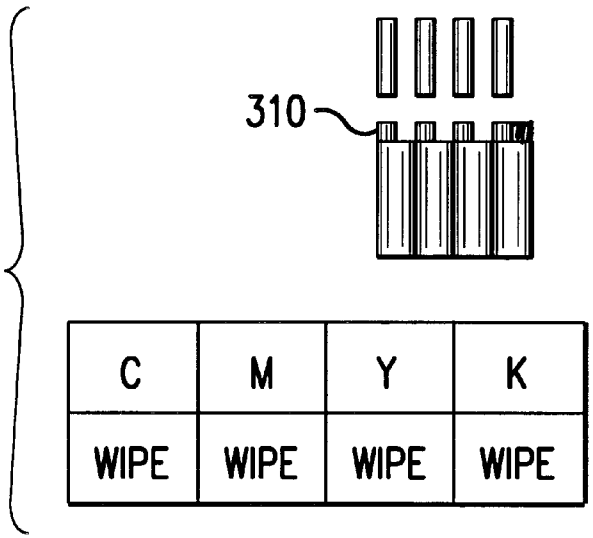

In FIGS. 12–13, the active aligned servicing function is shown as a solid arrow 302 while the inactive non-aligned servicing function is shown as a dotted arrow 304. Two exemplary functions are shown in FIGS. 12A–B (wiper 306, solvent applicator 308) while a single function such as wiping or other interactive printhead servicing function or component is designated as 310 in FIGS. 13–17.

Figure 15A:
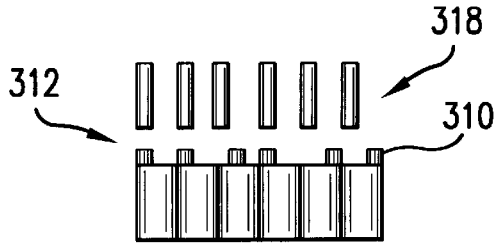
FIGS. 15A, 15B and 15C are schematic tabular representations of three different servicing modes for respectively servicing six printheads.
Figure 15B:
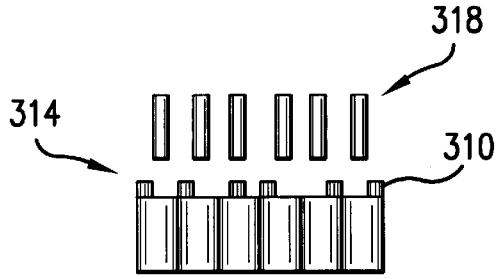
Figure 15C:
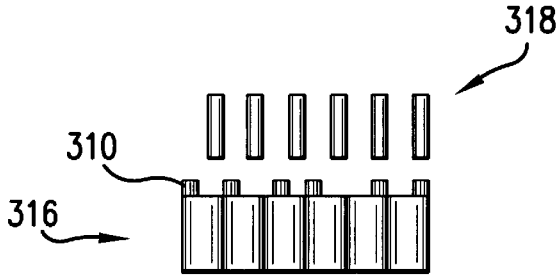
Figure 16A:
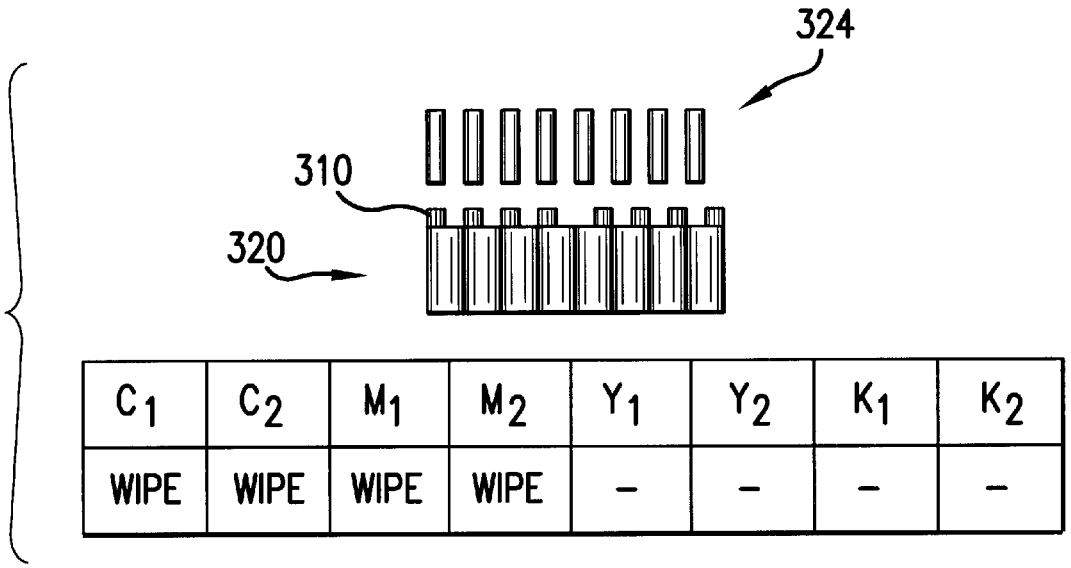
FIGS. 16A and 16B are schematic tabular representations of two different servicing modes for respectively servicing eight printheads.
Figure 16B:
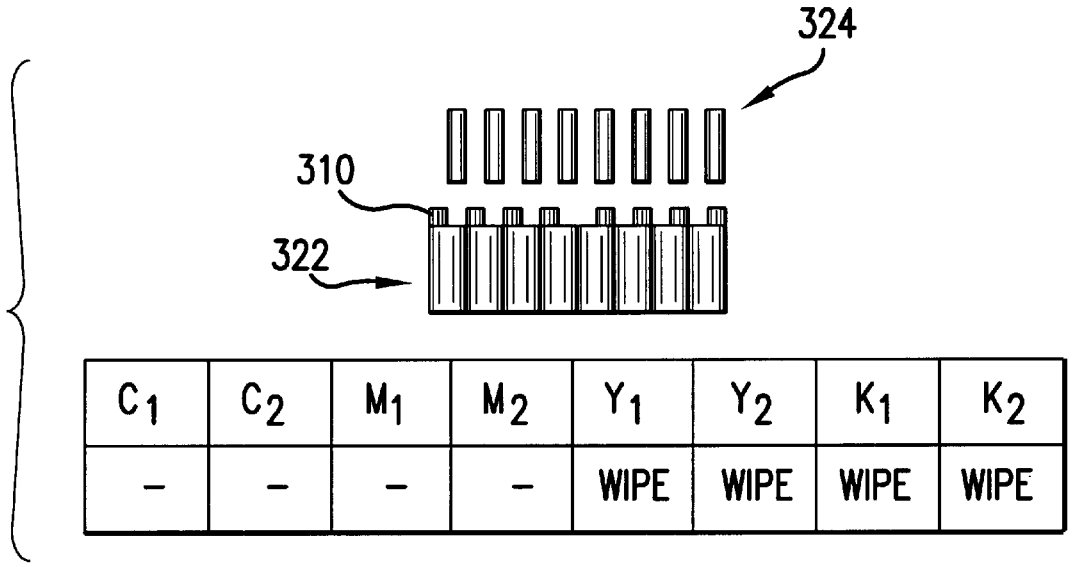
Figure 17A:
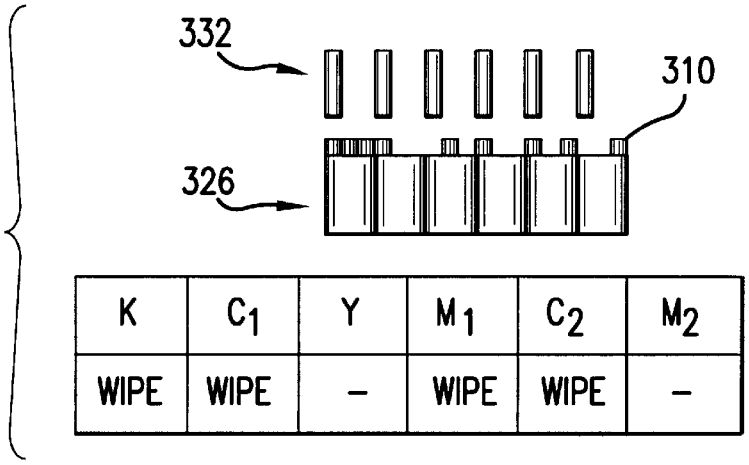
Figure 17B:
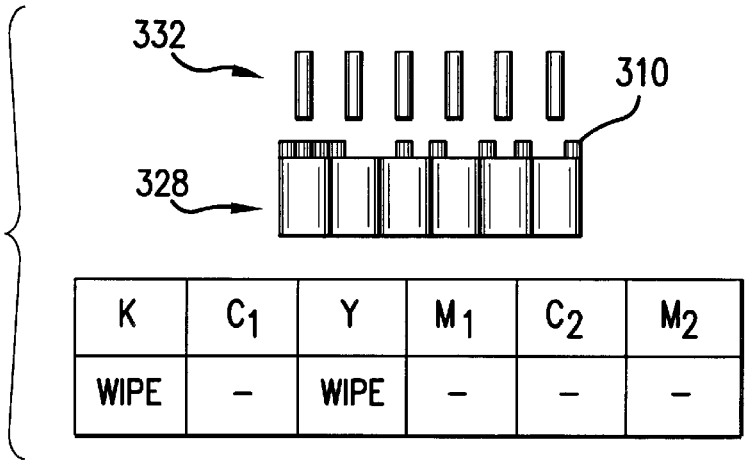
Figure 17C:
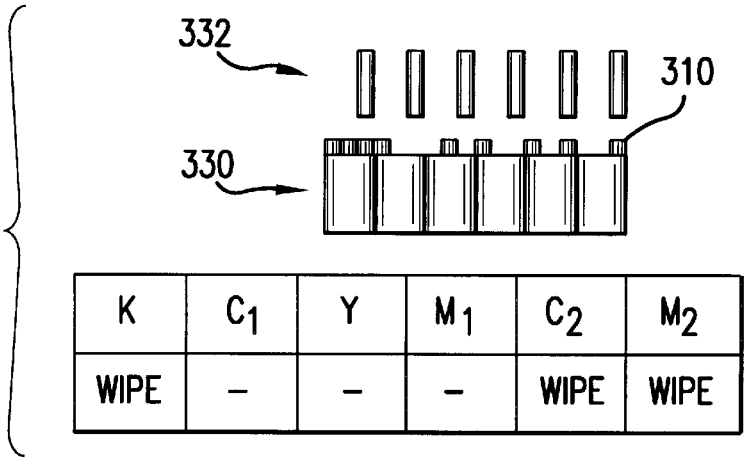

FIGS. 15A–C show three servicing modes 312, 314, 316 for a set of six pens 318. FIGS. 16A–B show two servicing modes 320, 322 for a set of eight pens 324. FIGS. 17A–C show three servicing modes 326, 328, 330 for a set of six pens 332. The designations $K_1K_2$, $C_1C_2$ and $M_1M_2$ represent examples of any different ink types, as for example, black, cyan and magenta, respectively.

It is apparent that a variety of modifications may be used to construct a replaceable service station unit for various implementations, while still implementing the various concepts and methods disclosed herein. For instance, while these printhead maintenance concepts have been illustrated in the context of a reciprocating printhead, it is apparent that they may be implemented to service other types of printheads, such as a page-wide array printhead which permanently expands the width of the active printzone, as well as other types of inkjet printing systems such as drum printers, all within the spirit and scope of the following claims.

We claim as our invention:

1. A maintenance system for servicing a plurality of printing components mounted in predetermined locations on a printer carriage comprising:

a carriage for holding the printing components in the predetermined locations, said carriage movable in a scanning axis direction;

a guide member for supporting said carriage in different servicing positions in proximity to a service station;

multiple servicing elements on the service station;

a first group of one or more of said servicing elements which are aligned for a first operational mode with at least one of the printing components when said carriage is in a first servicing position;

a second group of one or more of said servicing elements which are aligned for a second operational mode with at least another of the printing components when said carriage is in a second servicing position;

a motor coupled to said servicing elements for moving said first group and said second group of said servicing elements along a path substantially perpendicular to said scanning axis direction in order to provide interaction of said first group with at least one of the printing components during said first operational mode and in order to provide interaction of said second group with at least another of the printing components during said second operational mode; and wherein said first group of said-servicing elements are excluded from interaction with said at least another of the printing components during said first operational mode, and said second group of said servicing elements are excluded from interaction with said at least one of the printing components during said second operational mode.

2. The system of claim 1 wherein both said first and second groups of servicing elements include a servicing element performing a same type of servicing function for said first printhead and said second printhead, respectively.

3. The system of claim 1 wherein said first group of servicing elements includes one or more of the following: wiper, solvent applicator, cap, primer, spittoon.

4. The system of claim 1 wherein said second group of servicing elements includes one or more of the following: wiper, solvent applicator, cap, primer, spittoon.

5. The system of claim 1 which further includes a media advance direction perpendicular to said scanning axis direction, wherein a plurality of different printing components comprising inkjet printheads are held by said carriage in staggered relationship in said media advance direction to print non-overlapping swaths in a single pass of said carriage in said scanning axis direction.

6. The system of claim 1 which further includes a media advance direction perpendicular to said scanning axis direction, wherein a plurality of different printing components comprising inkjet printheads are held by said carriage in non-staggered relationship in said media advance direction to print at least partially overlapping swaths in a single pass of said carriage in said scanning axis direction.

7. The system of claim 1 wherein certain of said printing components are serviced in both said first operational mode and in said second operational mode.

8. The system of claim 1 wherein said first group of servicing elements includes two or more different servicing elements.

9. The system of claim 4 wherein said second group of servicing elements includes two or more different servicing elements.

10. The system of claim 1 wherein said motor moves said first group and said second group of said servicing elements during said first operational mode and said second operation mode, respectively, while said carriage remains stationary in said first and second servicing positions, respectively.

11. The system of claim 1 which includes a third group of said servicing elements which are aligned for a third operational mode with at least one of the printing components when said carriage is in a third servicing position.

12. A printer having a maintenance system for servicing a plurality of printheads on a printer carriage comprising:

a carriage for holding the plurality of printheads in locations which are spaced apart from each other a predetermined distance in a carriage scan direction;

a guide member supporting said carriage for movement in said carriage scan direction to a print zone and also to a service station zone;

a first motor coupled to said carriage for moving said carriage to a first stationary servicing mode position in said service station zone and to a second stationary servicing mode position in said service station zone;

one or more first servicing elements positioned in said service station zone for interactive engagement with at least one of said plurality of printheads when said carriage is in said first stationary servicing mode position;

one or more second servicing elements positioned in said service station zone for interactive engagement with at least another of said plurality of printheads when said carriage is in said second stationary servicing mode position;

wherein said first servicing mode position and said second servicing mode position are in different locations such that said first servicing elements are excluded from active operative engagement with said first printhead when said carriage is in said second stationary servicing mode position, and said second servicing element is excluded from active operative engagement with said second printhead when said carriage is in said first servicing mode position.

13. The system of claim 12 which further includes a second motor coupled to said servicing elements for moving said servicing elements along a path while said carriage is stationary during said first servicing mode and is stationary during said second servicing mode.

14. The system of claim 13 wherein said first and second servicing elements are mounted on a pallet holder, and said second motor moves said pallet holder along a linear path perpendicular to said carriage scanning direction when said carriage is in said first servicing position and in said second servicing position.

15. The system of claim 14 wherein said first servicing elements are part of a replaceable service component dedicated for servicing said at least one of said plurality of printheads.

16. The system of claim 12 wherein said second motor moves said servicing elements back and forth along a first path substantially perpendicular to said carriage scanning direction when said carriage is in said first servicing mode position.

17. The system of claim 16 wherein said second motor moves said servicing elements along a second path substantially perpendicular to said carriage scanning direction when said carriage is in said second servicing position.

18. The system of claim 12 wherein said first servicing elements include one or more of the following: wiper, solvent applicator, cap, primer, spittoon; and wherein said second servicing elements include one or more of the following wiper, solvent applicator, cap, primer, spittoon.

19. In a color printing system which includes a plurality of different printheads having different types of color inks and mounted on a scanning carriage which moves along a carriage scan axis between a print zone and a service station, a maintenance technique comprising the following method:

providing a separate replaceable servicing component associated respectively with each of the printheads, with each component having one or more servicing elements;

mounting the service station components in a housing which moves as a unit back and forth in a servicing direction;

moving the carriage to a first stationary servicing mode position along the carriage scan axis to be in interactive alignment with one set of servicing elements for servicing of a first group of the printheads;

actuating a motor to move the housing during a first time period while the carriage is in the first stationary servicing mode position in order to provide operative engagement between certain servicing elements of the one set with certain printheads of the first group;

moving the carriage to a second stationary servicing mode position along the carriage scan axis to be in interactive alignment with another set of servicing elements for servicing of a second group of the printheads;

actuating the motor to move the housing during a second different time period while the carriage is in the second stationary servicing mode position in order to provide operative engagement between certain servicing elements of the another set with certain printheads of the second group.

20. The method of claim 19 wherein said actuating moves the housing during both the first time period and during the second time period along a path which is substantially perpendicular to the carriage scan axis.

21. The method of claim 20 wherein said actuating moves the housing along a linear path which is substantially perpendicular to the carriage scan axis.

22. The method of claim 20 which further includes providing each component with one or more servicing elements taken from the following group: wiper, solvent applicator, cap, primer, spittoon.

* * * * *